US012385357B2

(12) United States Patent
Watkins et al.

(10) Patent No.: US 12,385,357 B2
(45) **Date of Patent: *Aug. 12, 2025**

(54) DEVICES, SYSTEMS, AND METHODS FOR SELECTIVELY ENGAGING DOWNHOLE TOOL FOR WELLBORE OPERATIONS

(71) Applicant: Advanced Upstream Ltd., Calgary (CA)

(72) Inventors: Tom Watkins, Calgary (CA); Jeyhun Najafov, Calgary (CA); Ratish Suhas Kadam, Calgary (CA); Henryk Kozlow, Calgary (CA)

(73) Assignee: Advanced Upstream Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/453,053

(22) Filed: Aug. 21, 2023

(65) Prior Publication Data

US 2023/0399909 A1 Dec. 14, 2023

Related U.S. Application Data

(63) Continuation of application No. 17/163,067, filed on Jan. 29, 2021, now Pat. No. 11,746,612.
(Continued)

(51) Int. Cl.
*E21B 34/14* (2006.01)
*E21B 47/092* (2012.01)

(52) U.S. Cl.
CPC ..... *E21B 34/142* (2020.05); *E21B 47/092* (2020.05); *E21B 2200/08* (2020.05)

(58) Field of Classification Search
CPC .... E21B 23/0414; E21B 47/092; E21B 47/09; E21B 34/142; E21B 33/10; E21B 2200/08
See application file for complete search history.

(56) References Cited

U.S. PATENT DOCUMENTS 1,624,742 A 4/1927 Kadel
2,152,306 A 3/1939 Grebe
(Continued)

FOREIGN PATENT DOCUMENTS

CA 2786784 A1 7/2011
CA 2799940 A1 11/2011
(Continued)

OTHER PUBLICATIONS

First Chinese Office Action Issued in Chinese Application No. 202180011558.8 dated May 24, 2024.
(Continued)

*Primary Examiner* — D. Andrews
(74) *Attorney, Agent, or Firm* — Smart & Biggar LP

(57) ABSTRACT

A device for wellbore operations is configured to self-determine its downhole location in a wellbore in real-time and to self-activate upon arrival at a preselected target location. The device determines its downhole location based on magnetic field and/or magnetic flux signals provided by an onboard three-axis magnetometer. The device optionally comprises one or more magnets. The magnetometer detects changes in magnetic field and/or magnetic flux caused by the device's proximity to or passage through various features in the wellbore. The device can self-activate to deploy an engagement mechanism to engage a target tool downhole from the target location. The engagement mechanism comprises a seal supported by two expandable support rings, each having a respective elliptical face for engagement with the elliptical face of the other support ring.

17 Claims, 19 Drawing Sheets

Related U.S. Application Data

(60) Provisional application No. 62/968,074, filed on Jan. 30, 2020.

(56) References Cited

U.S. PATENT DOCUMENTS

| | | | |
|---|---|---|---|
| 3,061,013 | A | 10/1962 | Thomas, Jr. |
| 3,623,551 | A | 11/1971 | Randermann, Jr. |
| 3,631,925 | A | 1/1972 | Nutter |
| 3,819,850 | A | 6/1974 | Perry et al. |
| 3,991,826 | A | 11/1976 | Baugh |
| 4,098,334 | A | 7/1978 | Crowe |
| 5,720,345 | A | 2/1998 | Price |
| 6,598,672 | B2 | 7/2003 | Bell et al. |
| 7,252,152 | B2 | 8/2007 | LoGiudice et al. |
| 7,363,967 | B2 | 4/2008 | Burris, II et al. |
| 7,503,398 | B2 | 3/2009 | LoGiudice et al. |
| 7,622,916 | B2 | 11/2009 | Meeten et al. |
| 8,322,426 | B2 | 12/2012 | Wright |
| 8,487,626 | B2 | 7/2013 | Khan et al. |
| 8,505,632 | B2 | 8/2013 | Guerrero et al. |
| 8,505,639 | B2 | 8/2013 | Robison et al. |
| 9,441,470 | B2 | 9/2016 | Guerrero et al. |
| 9,534,471 | B2 | 1/2017 | Etzel |
| 9,567,832 | B2 | 2/2017 | Hofman et al. |
| 9,587,477 | B2 | 3/2017 | Lafferty et al. |
| 9,611,709 | B2 | 3/2017 | O'Malley |
| 9,631,468 | B2 | 4/2017 | Miller |
| 9,650,851 | B2 | 5/2017 | Whitsitt et al. |
| 9,683,419 | B2 | 6/2017 | Coon |
| 9,822,610 | B2 | 11/2017 | Delzell et al. |
| 9,822,611 | B2 | 11/2017 | Delzell et al. |
| 10,138,713 | B2 | 11/2018 | Tolman et al. |
| 10,301,910 | B2 | 5/2019 | Whitsitt et al. |
| 10,301,927 | B2 | 5/2019 | Sallwasser et al. |
| 10,316,645 | B2 | 6/2019 | Ingraham et al. |
| 10,370,917 | B2 | 8/2019 | Coon |
| 10,392,910 | B2 | 8/2019 | Walton et al. |
| 10,435,982 | B2 | 10/2019 | Shkurti et al. |
| 10,436,017 | B2 | 10/2019 | Coss et al. |
| 10,465,499 | B2 | 11/2019 | Budler |
| 10,519,765 | B2 | 12/2019 | Budler |
| 10,544,670 | B2 | 1/2020 | Hay |
| 10,570,695 | B2 | 2/2020 | Fitzhugh et al. |
| 10,598,002 | B2 | 3/2020 | Sites |
| 10,662,732 | B2 | 5/2020 | Frazier |
| 11,746,612 | B2 * | 9/2023 | Watkins ..... E21B 23/0414 166/255.2 |
| 2003/0117134 | A1 | 6/2003 | Almagher |
| 2007/0221384 | A1 | 9/2007 | Murray |
| 2009/0084546 | A1 | 4/2009 | Ekseth |
| 2011/0227564 | A1 | 9/2011 | Martin et al. |
| 2012/0226443 | A1 | 9/2012 | Cresswell et al. |
| 2012/0085538 | A1 | 12/2012 | Guerrero et al. |
| 2014/0002071 | A1 | 1/2014 | Martin |
| 2014/0076542 | A1 | 3/2014 | Whitsitt |
| 2015/0025805 | A1 | 1/2015 | Hanak |
| 2015/0167428 | A1 | 6/2015 | Hofman |
| 2015/0218904 | A1 | 8/2015 | Chauffe et al. |
| 2015/0226035 | A1 | 8/2015 | Jani |
| 2015/0247375 | A1 | 9/2015 | Stout |
| 2015/0361747 | A1 | 12/2015 | Lafferty et al. |
| 2016/0084075 | A1 | 3/2016 | Ingraham et al. |
| 2016/0108722 | A1 | 4/2016 | Whitsitt |
| 2016/0258260 | A1 | 9/2016 | Walton et al. |
| 2016/0298422 | A1 | 10/2016 | Hyde, Jr. |
| 2016/0333661 | A1 | 11/2016 | Sallwasser |
| 2016/0376869 | A1 | 12/2016 | Rochen |
| 2017/0191340 | A1 | 7/2017 | Deng et al. |
| 2017/0342794 | A1 | 11/2017 | Silva et al. |
| 2017/0342823 | A1 | 11/2017 | Shah et al. |
| 2017/0370176 | A1 | 12/2017 | Frazier |
| 2018/0084495 | A1 | 4/2018 | Wardley et al. |
| 2018/0135378 | A1 | 5/2018 | Budde |
| 2018/0371894 | A1 | 12/2018 | Wang et al. |
| 2019/0323316 | A1 | 1/2019 | Brown |
| 2019/0085685 | A1 | 3/2019 | McBride |
| 2019/0136685 | A1 | 5/2019 | Adetola et al. |
| 2019/0153816 | A1 | 5/2019 | Campbell |
| 2019/0332089 | A1 | 10/2019 | Deffenbaugh et al. |
| 2019/0352998 | A1 | 11/2019 | Wolf et al. |
| 2020/0063553 | A1 | 2/2020 | Zemla et al. |
| 2020/0165893 | A1 | 5/2020 | Varhaug et al. |
| 2020/0270960 | A1 | 8/2020 | Watkins et al. |
| 2020/0347693 | A1 | 11/2020 | Wood et al. |

FOREIGN PATENT DOCUMENTS

| | | | |
|---|---|---|---|
| CA | 2839010 | A1 | 3/2016 |
| CA | 2909574 | A1 | 4/2016 |
| CA | 2995420 | A1 | 8/2016 |
| CA | 2882582 | C | 5/2017 |
| CA | 2819372 | C | 7/2017 |
| CA | 2799618 | C | 9/2017 |
| CA | 3030223 | A1 | 1/2019 |
| CA | 3071108 | A1 | 1/2019 |
| CA | 2813645 | C | 10/2019 |
| CA | 3013446 | A | 2/2020 |
| WO | 2016028154 | A1 | 2/2016 |
| WO | 2019165291 | A1 | 8/2019 |
| WO | 2019229521 | A1 | 12/2019 |
| WO | 2020024057 | A1 | 2/2020 |
| WO | 2020086892 | A1 | 4/2020 |
| WO | 2020086961 | A1 | 4/2020 |

OTHER PUBLICATIONS

Extended European Search Report cited in European Patent Application No. 21747248.9, Dec. 19, 2023.
Office Action issued in Canadian Application No. 3149077 Dec. 20, 2023.
CA Office Action issued on Canadian Application No. 3149077 Apr. 25, 2022.
CA Office Action issued on Canadian Application No. 3149077 Jun. 21, 2022.
WO—ISR/WO issued in PCT/CA2022/050112 May 3, 2022.
First Office Action issued in corresponding Saudi Arabian Application No. 522440004 dated Sep. 2, 2024.
Summary of the First Office Action issued in corresponding Saudi Arabian Application No. 522440004 in English.
Second Office Action issued in related Chinese Application No. 202180011558.8 dated Oct. 10, 2024.
English Summary of Second Office Action issued in related Chinese Application No. 202180011558.8 dated Oct. 10, 2024.
Third Office Action issued in corresponding Chinese Application No. 202180011558.8 dated Feb. 19, 2025.
Summary of the Third Office Action issued in corresponding Chinese Application No. 202180011558.8 in English.
Office Action issued in corresponding Saudi Arabia Application No. 524462321 dated Apr. 22, 2025.
Summary of Office Action issued in corresponding Saudia Arabia Application No. 524462321 in English.
Office Action issued in corresponding Saudi Arabia Application No. 524462320 dated Apr. 22, 2025.
Summary of Office Action issued in corresponding Saudi Arabia Application No. 524462320 in English.

* cited by examiner

DEVICES, SYSTEMS, AND METHODS FOR SELECTIVELY ENGAGING DOWNHOLE TOOL FOR WELLBORE OPERATIONS

CROSS-REFERENCE TO RELATED APPLICATIONS

This application is a continuation of U.S. Pat. No. 11,746,612 filed Jan. 29, 2021, which claims the benefit of U.S. Provisional Application Ser. No. 62/968,074, filed Jan. 30, 2020, the contents of which are hereby incorporated by reference in their entirety.

FIELD

The invention relates to devices, systems, and methods for performing downhole operations, and in particular to devices configured to determine its downhole location in a wellbore and, based on the determination, self-activate to effect a downhole operation, and systems and methods related thereto.

BACKGROUND

Recently wellbore treatment apparatus have been developed that include a wellbore treatment string for staged well treatment. The wellbore treatment string is useful to create a plurality of isolated zones within a well and includes an openable port system that allows selected access to each such isolated zone. The treatment string includes a tubular string carrying a plurality of external annular packers that can be set in the hole to create isolated zones therebetween in the annulus between the tubing string and the wellbore wall, be it cased or open hole. Openable ports, passing through the tubing string wall, are positioned between the packers and provide communication between the tubing string inner bore and the isolated zones. The ports are selectively openable and include a sleeve thereover with a sealable seat formed in the inner diameter of the sleeve. By launching a plug, such as a ball, a dart, etc., the plug can seal against the seat of a port's sleeve and pressure can be increased behind the plug to drive the sleeve through the tubing string to open the port and gain access to an isolated zone. The seat in each sleeve can be formed to accept a plug of a selected diameter but to allow plugs of smaller diameters to pass. As such, a port can be selectively opened by launching a particular sized plug, which is selected to seal against the seat of that port.

Unfortunately, however, such a wellbore treatment system tends to be limited in the number of zones that may be accessed. In particular, limitations with respect to the inner diameter of wellbore tubulars, often due to the inner diameter of the well itself, restrict the number of different sized seats that can be installed in any one string. For example, if the well diameter dictates that the largest sleeve seat in a well can at most accept a 3¾" plug, then the well treatment string will generally be limited to approximately eleven sleeves and, therefore, treatment can only be effected in eleven stages. Therefore, it is desirable to have a wellbore treatment system that allows the same size sleeve seats to be used throughout the tubing string so that the wellbore treatment system can have more stages. Also, if the sleeve seats in the tubing string are identical to one another, the sleeve seats do not have to be installed in any particular order.

In some situations, the plug is configured to seal the wellbore during a well completion operation, such as fracking in the zone through the open port. Rubber and other elastomeric materials are commonly used as seals in settable plugs. A general problem in the art is the undesired deformation of the seal during setting, and also subsequent deformation, both due to extrusion of the seal material. Under axial compression, extrusion can occur in conventional seal rings through any gaps in or around the compression ring of the compression setting mechanism. Such extrusion can cause the seal to deform, crack up, or erode, thereby compromising the seal's integrity which may lead to unwanted leakages.

The present disclosure thus aims to address the above-mentioned issues.

SUMMARY

According to a broad aspect of the present disclosure, there is provided a method comprising: deploying a device into a passageway of a tubing string; measuring, by a magnetometer in the device, an x-axis magnetic field in an x-axis, a y-axis magnetic field in a y-axis, and a z-axis magnetic field in a z-axis, the z-axis being parallel to a direction of travel of the device, and the x-axis and y-axis being orthogonal to the z-axis and to each other; generating one or more of: an x-axis signal based on the x-axis magnetic field, a y-axis signal based on the y-axis magnetic field, and a z-axis signal based on the z-axis magnetic field; and monitoring one or more of the x-axis, y-axis, and z-axis signals to detect a change; and analyzing the change to detect at least one feature in the tubing string, wherein the change is caused by one of: a movement of a first magnet in the device relative to a second magnet in the device; proximity of the device to the at least one feature, each of the at least one feature being a magnetic feature; and proximity of the at least one feature to a third magnet in the device.

In some embodiments, the change is caused by the movement of the first magnet relative to the second magnet, and the change comprises a change in the z-axis signal, and analyzing comprises determining whether the change in the z-axis signal is greater than or equal to a predetermined threshold magnitude.

In some embodiments, analyzing comprises, upon determining that the change in the z-axis signal is greater than or equal to the predetermined threshold magnitude, determining whether the y-axis signal is within a baseline window during the change in the z-axis signal.

In some embodiments, analyzing comprises, upon determining that the change in the z-axis signal is greater than or equal to the predetermined threshold magnitude, determining whether the y-axis signal is within a baseline window during a maximum of the change in the z-axis signal.

In some embodiments, analyzing comprises, upon determining that the y-axis signal is within the baseline window, determining whether the y-axis signal is within the baseline window for longer than a threshold timespan.

In some embodiments, the method comprises adjusting a baseline of the y-axis signal based at least in part on the x-axis signal.

In some embodiments, the first magnet and the second magnet are rare-earth magnets.

In some embodiments, the first magnet is embedded in a first retractable protrusion of the device and the second magnet is embedded in a second retractable protrusion of the device, the first and second retractable protrusions positioned at about the same axial location on an outer surface of the device, and the at least one feature comprises a constriction.

In some embodiments, the first and second retractable protrusions are azimuthally spaced apart by about 180°, and the y-axis is parallel to a direction of retraction of the first and second retractable protrusions.

In some embodiments, the change is caused by the proximity of the device to the at least one feature, and wherein monitoring comprises calculating an ambient magnetic field M using:

$$M=\sqrt{(x+c)^2+(y+d)^2}$$

where x is the magnitude of the x-axis signal, y is the magnitude of the y-axis signal, and c and d are adjustment constants for the x-axis and y-axis signals, respectively, and the change comprises a change in the ambient magnetic field.

In some embodiments, analyzing comprises determining whether the change falls within a parameters profile of one of the at least one feature.

In some embodiments, the parameters profile comprises a minimum magnetic field threshold, and determining whether the change falls within the parameters profile comprises determining whether the ambient magnetic field is greater than or equal to the minimum magnetic field threshold.

In some embodiments, the parameters profile comprises a maximum magnetic field threshold, and determining whether the change falls within the parameters profile comprises: starting a timer upon determining that the ambient magnetic field is greater than or equal to the minimum magnetic field threshold; monitoring, after starting the timer, the ambient magnetic field to determine whether the ambient magnetic field is less than the minimum magnetic field threshold or is greater than the maximum magnetic field threshold; and stopping the timer upon determining that the ambient magnetic field is less than the minimum magnetic field threshold or is greater than the maximum magnetic field threshold, to provide an elapsed time between the starting of the timer and the stopping of the timer.

In some embodiments, the parameters profile comprises a minimum timespan and a maximum timespan, and determining whether the change falls within the parameters profile comprises determining whether the elapsed time is between the minimum timespan and the maximum timespan.

In some embodiments, the change is caused by the proximity of the at least one feature to the third magnet, and monitoring comprises calculating a magnetic field M of the third magnet using:

$$M=\sqrt{(x+p)^2+(y+q)^2+(z+r)^2}$$

where x is the magnitude of the x-axis signal, y is the magnitude of the y-axis signal, z is the magnitude of the z-axis signal, and p, q, and r are the adjustment constants for x-axis, y-axis, and z-axis signals, respectively, and the change comprises a change in the magnetic field of the third magnet.

In some embodiments, analyzing comprises determining whether the change falls within a parameters profile of one of the at least one feature.

In some embodiments, the parameters profile comprises a minimum magnetic field threshold, and determining whether the change falls within the parameters profile comprises determining whether the magnetic field of the third magnet is greater than or equal to the minimum magnetic field threshold.

In some embodiments, the parameters profile comprises a maximum magnetic field threshold, and determining whether the change falls within the parameters profile comprises: starting a timer upon determining that the magnetic field of the third magnet is greater than or equal to the minimum magnetic field threshold; monitoring, after starting the timer, the magnetic field of the third magnet to determine whether the magnetic field of the third magnet is less than the minimum magnetic field threshold or is greater than the maximum magnetic field threshold; and stopping the timer upon determining that the magnetic field of the third magnet is less than the minimum magnetic field threshold or is greater than the maximum magnetic field threshold, to provide an elapsed time between the starting of the timer and the stopping of the timer.

In some embodiments, the parameters profile comprises a minimum timespan and a maximum timespan, and determining whether the change falls within the parameters profile comprises determining whether the elapsed time is between the minimum timespan and the maximum timespan.

In some embodiments, each of the at least one feature is a magnetic feature or a thicker feature.

In some embodiments, each of the at least one feature is magnetic feature, and wherein a first feature of the at least one feature has a first parameters profile and a second feature of the at least one feature has a second parameters profile, the first parameters profile being different from the second parameters profile.

In some embodiments, the method comprises, upon detecting one of the at least one feature, one or both of: incrementing a counter; and determining a location of the device in the tubing string.

In some embodiments, the method comprises, prior to deploying the device, setting a target location; after incrementing the counter and/or determining the location, comparing the counter or the location with the target location to determine whether the counter or the location has reached the target location; and upon determining that the counter or the location has reached the target location, activating the device.

In some embodiments, activating the device comprises actuating an engagement mechanism of the device.

In some embodiments, the method comprises determining a distance travelled by the device based at least in part on an acceleration of the device measured by an accelerometer in the device.

In some embodiments, determining the distance is based at least in part on a rotation of the device measured by a gyroscope in the device.

According to another broad aspect of the present disclosure, there is provided a downhole tool comprising: a first support ring having: a first face at a first end; a first elliptical face at a second end, the first face and the first elliptical face having a first gap extending therebetween; and a second support ring having: a second face at a first end; a second elliptical face at a second end, the second elliptical face being adjacent to the first elliptical face and configured to matingly abut against the first elliptical face, the second face and the second elliptical face having a second gap extending therebetween, the first and second support rings being expandable from an initial position to an expanded position, wherein in the expanded position, the first and second gaps are widened compared to the initial position.

In some embodiments, the first support ring comprises: a first short side having a first short side length; and a first long side having a first long side length, the first long side length being greater than the first short side length, and each of the first face and the first elliptical face extending from the first short side to the first long side; and the second support ring comprises: a second short side having a second short side length; and a second long side having a second long side length, the second long side length being greater than the second short side length, and each of the second face and the second elliptical face extending from the second short side to the second long side.

In some embodiments, the second long side length is equal to or greater than the first long side length.

In some embodiments, second short side length is equal to or greater than the first short side length.

In some embodiments, the second long side length is less than the first long side length.

In some embodiments, second short side length is less than the first short side length.

In some embodiments, the first gap is positioned at or near the first short side.

In some embodiments, the second gap is positioned at or near the second short side.

In some embodiments, the second short side is positioned adjacent to the first long side; and the second long side is positioned adjacent to the first short side.

In some embodiments, the first gap is azimuthally offset from the second gap.

In some embodiments, one or both of the first and second faces are circular.

In some embodiments, the first elliptical face is inclined at an angle ranging from about 1° to about 30° relative to the first face.

In some embodiments, one or more of: the first short side length is about 10% to about 30% of the first long side length; the first short side length is about 18% to about 38% of the second short side length; and the first short side length is about 3% to about 23% of the second long side length.

In some embodiments, one or more of: the second short side length is about 10% to about 30% of the second long side length; the second short side length is about 18% to about 38% of the first short side length; and the second short side length is about 3% to about 23% of the first long side length.

In some embodiments, in the expanded position, at least a portion of the first support ring is radially offset from the second support ring.

In some embodiments, in the expanded position, the first gap has less volume than the second gap.

In some embodiments, the downhole tool comprises a cone and an annular seal, and wherein the first support ring, the second support ring, and the seal are supported on an outer surface of the cone, the seal being adjacent to the first face.

In some embodiments, the downhole tool comprises: an inactivated position in which the annular seal and the first and second support rings are at a first axial location of the cone, and the first and second rings are in the initial position; and an activated position in which the annular seal and the first and second support rings are at a second axial location of the cone, and the first and second support rings are in the expanded position, wherein an outer diameter of the second axial location is greater than an outer diameter of the first axial location, and an outer diameter of the annular seal is greater in the activated position than in the inactivated position.

In some embodiments, the first short side length is about 6% to about 26% of an axial length of the annular seal.

In some embodiments, the second long side length is about 109% to about 129% of an axial length of the annular seal.

In some embodiments, wherein the first and second support rings each have a respective frustoconical inner surface for matingly abutting against the outer surface of the cone.

In some embodiments, one or both of the first and second support rings comprise a dissolvable material.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

FIGS. 2A to 2C may be collectively referred to herein as FIG. 2.

FIGS. 3A, 3B, and 3C may be collectively referred to herein as FIG. 3.

FIGS. 7A to 7C may be collectively referred to herein as FIG. 7.

FIGS. 8A to 8C may be collectively referred to herein as FIG. 8.

FIGS. 9A to 9C may be collectively referred to herein as FIG. 9.

FIGS. 10A to 10C may be collectively referred to herein as FIG. 10.

FIGS. 11A and 11B may be collectively referred to herein as FIG. 11.

FIGS. 12A and 12B may be collectively referred to herein as FIG. 12.

DETAILED DESCRIPTION

Figure 1A:
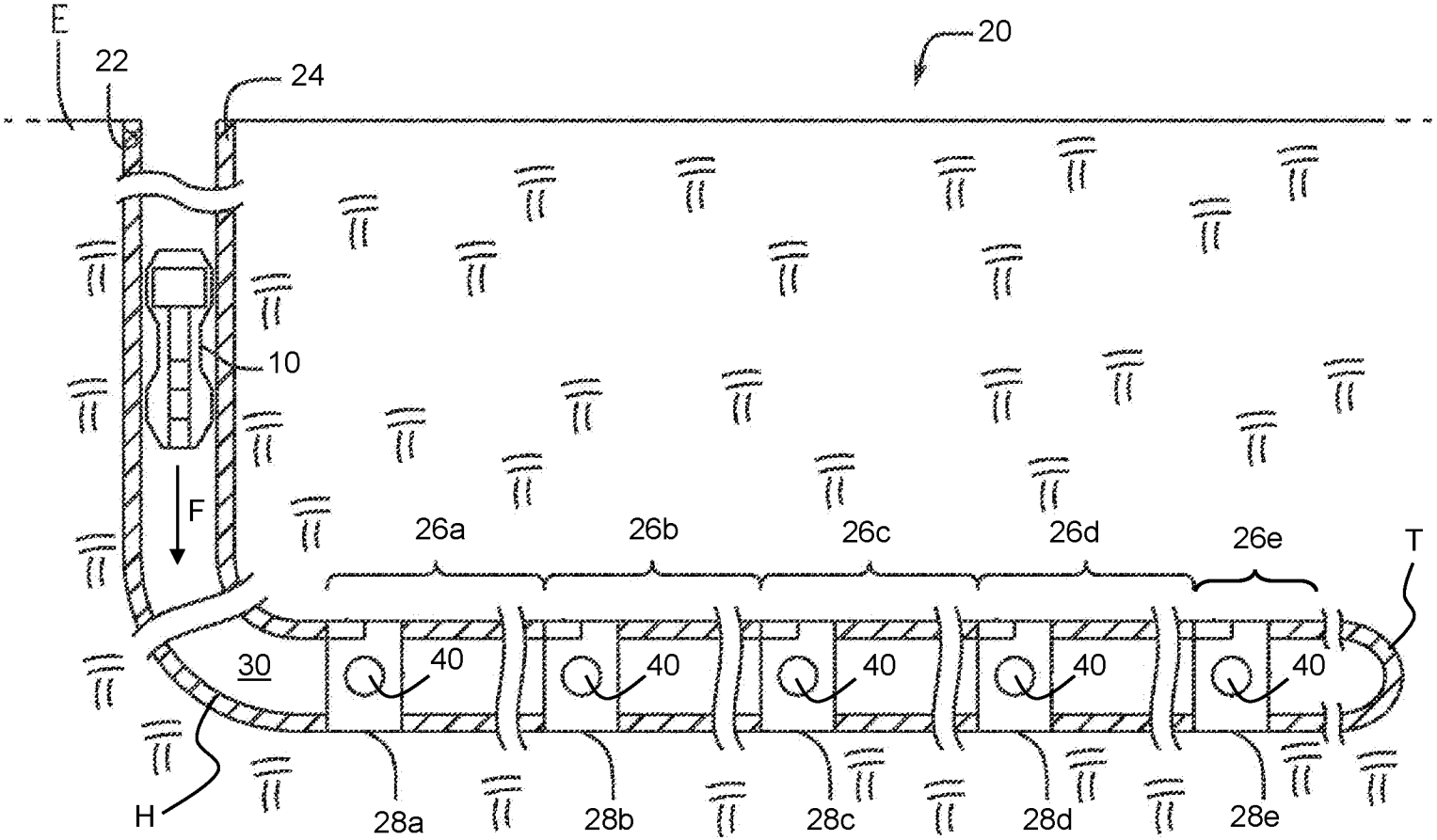
FIG. 1A is a schematic drawing of a multiple stage well according to one embodiment of the present disclosure.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

In general, methods are disclosed herein for purposes of deploying a device into a wellbore that extends through a subterranean formation, and using an autonomous operation of the device to perform a downhole operation that may or may not involve actuation of a downhole tool. In some embodiments, the device is an untethered object sized to travel through a passageway (e.g. the inner bore of a tubing string) and various tools in the tubing string. The device may also be referred to as a dart, a plug, a ball, or a bar and may take on different forms. The device may be pumped into the tubing string (i.e., pushed into the well with fluid), although pumping may not be necessary to move the device through the tubing string in some embodiments.

In some embodiments, the device is deployed into the passageway, and is configured to autonomously monitor its position in real-time as it travels in the passageway, and upon determining that it has reached a given target location in the passageway, autonomously operates to initiate a downhole operation. In some embodiments, the device is deployed into the passageway in an initial inactivated position and remains so until the device has determined that it has reached the predetermined target location in the passageway. Once it reaches the predetermined target location, the device is configured to selectively self-activate into an activated position to effect the downhole operation. As just a few examples, the downhole operation may be one or more of: a stimulation operation (a fracturing operation or an acidizing operation as examples); an operation performed by a downhole tool (the operation of a downhole valve, the operation of a packer the operation of a single shot tool, or the operation of a perforating gun, as examples); the formation of a downhole obstruction; the diversion of fluid (the diversion of fracturing fluid into a surrounding formation, for example); the pressurization of a particular stage of a multiple stage well; the shifting of a sleeve of a downhole tool; the actuation of a downhole tool; and the installation of a check valve in a downhole tool. A stimulation operation includes stimulation of a formation, using stimulation fluids, such as for example, acid, water, oil, $CO_2$ and/or nitrogen, with or without proppants.

In some embodiments, the preselected target location is a position in the passageway that is uphole from a target tool in the passageway to thereby allow the device to determine its impending arrival at the target tool. By determining its real-time location, the device can self-activate in anticipation of its arrival at the target tool downhole therefrom. In some embodiments, the target location may be a specific distance downhole relative to, for example, the surface opening of the wellbore. In other embodiments, the target location is a downhole position in the passageway somewhere uphole from the target tool.

As disclosed herein, in some embodiments, the device may monitor and/or determine its position based on physical contact with and/or physical proximity to one or more features in the passageway. Each of the one or more features may or may not be part of a tool in the passageway. For example, a feature in the passageway may be a change in geometry (such as a constriction), a change in physical property (such as a difference in material in the tubing string), a change in magnetic property, a change in density of the material in the tubing string, etc. In alternative or additional embodiments, the device may monitor and/or determine its downhole location by detecting changes in magnetic flux as the device travels through the passageway. In alternative or additional embodiments, the device may monitor and/or determine its position in the passageway by calculating the distance the device has traveled based, at least in part, on acceleration data of the device.

In some embodiments, the device comprises a body, a control module, and an actuation mechanism. In the inactivated position, the body of the device is conveyable through the passageway to reach the target location. The control module is configured to determine whether the device has reached the target location, and upon such determination, cause the actuation mechanism to operate to transition the device into the activated position. In embodiments where the device is employed to actuate a target tool, the device in its activated position may actuate the target tool by deploying an engagement mechanism to engage with the target tool and/or create a seal in the tubing string adjacent the target tool to block fluid flow therepast, to for example divert fluids into the subterranean formation.

In some embodiments, in the inactivated position, the device is configured to pass through downhole constrictions (valve seats or tubing connectors, for example), thereby allowing the device to be used in, for example, multiple stage applications in which the device is used in conjunction with seats of the same size so that the device may be selectively configured to engage a specific seat. The device and related methods may be used for staged injection of treatment fluids wherein fluid is injected into one or more selected intervals of the wellbore, while other intervals are closed. In some embodiments, the tubing string has a plurality of port subs along its length and the device is configured to contact and/or detect the presence of at least some of the features along the tubing string to determine its impending arrival at a target tool (e.g. a target port sub). Upon such determination, the device self-activates to open the port of the target port sub such that treatment fluid can be injected through the open port to treat the interval of the subterranean formation that is accessible through the port.

The devices and methods described herein may be used in various borehole conditions including open holes, cased holes, vertical holes, horizontal holes, straight holes or deviated holes.

Referring to FIG. 1A, in accordance with some embodiments, a multiple stage ("multistage") well 20 includes a wellbore 22, which traverses one or more subterranean formations (hydrocarbon bearing formations, for example). In some embodiments, the wellbore 22 may be lined, or supported, by a tubing string 24. The tubing string 24 may be cemented to the wellbore 22 (such wellbores typically are referred to as "cased hole" wellbores); or the tubing string 24 may be secured to the formation by packers (such wellbores typically are referred to as "open hole" wellbores). In general, the wellbore 22 extends through one or multiple zones, or stages. In a sample embodiment, as shown in FIG. 1A, wellbore 22 has five stages 26*a*,26*b*,26*c*,26*d*,26*e*. In other embodiments, wellbore 22 may have fewer or more stages. In some embodiments, the well 20 may contain multiple wellbores, each having a tubing string that is similar to the illustrated tubing string 24. In some embodiments, the well 20 may be an injection well or a production well.

In some embodiments, multiple stage operations may be sequentially performed in well 20, in the stages 26*a*,26*b*, 26*c*,26*d*,26*e* thereof in a particular direction (for example, in a direction from the toe T of the wellbore 22 to the heel H of the wellbore 22) or may be performed in no particular direction or sequence, depending on the particular multiple stage operation.

In the illustrated embodiment, the well 20 includes downhole tools 28*a*,28*b*,28*c*,28*d*,28*e* that are located in the respective stages 26*a*,26*b*,26*c*,26*d*,26*e*. Each tool 28*a*,28*b*, 28*c*,28*d*,28*e* may be any of a variety of downhole tools, such as a valve (a circulation valve, a casing valve, a sleeve valve, and so forth), a seat assembly, a check valve, a plug assembly, and so forth, depending on the particular embodiment. Moreover, all the tools 28*a*,28*b*,28*c*,28*d*,28*e* may not necessarily be the same and the tools 28*a*,28*b*,28*c*,28*d*,28*e* may comprise a mixture and/or combination of different tools (for example, a mixture of casing valves, plug assemblies, check valves, etc.).

Each tool 28*a*,28*b*,28*c*,28*d*,28*e* may be selectively actuated by a device 10, which in the illustrated embodiment is a dart, deployed through the inner passageway 30 of the tubing string 24. In general, the dart 10 has an inactivated position to permit the dart to pass relatively freely through the passageway 30 and through one or more tools 28*a*,28*b*, 28*c*,28*d*,28*e*, and the dart 10 has an activated position, in which the dart is transformed to thereby engage a selected one of the tools 28*a*,28*b*,28*c*,28*d*, or 28*e* (the "target tool") or be otherwise secured at a selected downhole location, for example, for purposes of performing a particular downhole operation. Engaging a downhole tool may include one or more of: physically contacting, wirelessly communicating with, and landing in (or "being caught by") the downhole tool.

In the illustrated embodiment shown in FIG. 1A, dart 10 is deployed from the opening of the wellbore 22 at the Earth surface E into passageway 30 of tubing string 24 and propagates along passageway 30 in a downhole direction F until the dart 10 determines its impending arrival at the target tool, for example tool 28*d* (as further described hereinbelow), transforms from its initial inactivated position into the activated position (as further described hereinbelow), and engages the target tool 28*d*. It is noted that the dart 10 may be deployed from a location other than the Earth surface E. For example, the dart 10 may be released by a downhole tool. As another example, the dart 10 may be run downhole on a conveyance mechanism and then released downhole to travel further downhole untethered.

In some embodiments, each stage 26*a*,26*b*,26*c*,26*d*,26*e* has one or more features 40. Any of the features 40 may be part of the tool itself 28*a*,28*b*,28*c*,28*d*,28*e* or may be positioned elsewhere within the respective stage 26*a*,26*b*,26*c*, 26*d*,26*e*, for example at a defined distance from the tool within the stage. In some embodiments, a feature 40 may be another downhole tool, such as a port sub, that is separate from tool 28*a*,28*b*,28*c*,28*d*,28*e* and positioned within the corresponding stage. In some embodiments, a feature 40 may be positioned between adjacent tools or at an intermediate position between adjacent tools, such as a joint between adjacent segments of the tubing string. In some embodiments, a stage 26*a*,26*b*,26*c*,26*d*,26*e* may contain multiple features 40 while another stage may not contain any features 40. In some embodiments, the features 40 may or may not be evenly/regularly distributed along the length of passageway 30. As a person in the art can appreciate, other configurations are possible. In some embodiments, the downhole locations of the features 40 in the tubing string 24 are known prior to the deployment of the dart 10, for example via a well map of the wellbore 22.

In some embodiments, the dart 10 autonomously determines its downhole location in real-time, remains in the inactivated position to pass through tool(s) (e.g. 28*a*,28*b*, 28*c*) uphole of the target tool 28*d*, and transforms into the activated position before reaching the target tool 28*d*. In some embodiments, the dart 10 determines its downhole location within the passageway by physical contact with one or more of the features 40 uphole of the target tool. In alternative or additional embodiments, the dart 10 determines its downhole location by detecting the presence of one or more of the features 40 when the dart 10 is in close proximity with the one or more features 40 uphole of the target tool. In alternative or additional embodiments, the dart 10 determines its downhole location by detecting changes in magnetic field and/or magnetic flux as the dart travels through the passageway 30. In alternative or additional embodiments, the dart 10 determines its downhole location by calculating the distance the dart has traveled based on real-time acceleration data of the dart. The above embodiments may be used alone or in combination to ascertain the (real-time) downhole location of the dart. The results obtained from two or more of the above embodiments may be correlated to determine the downhole location of the dart more accurately. The various embodiments will be described in detail below.

Figure 2A:
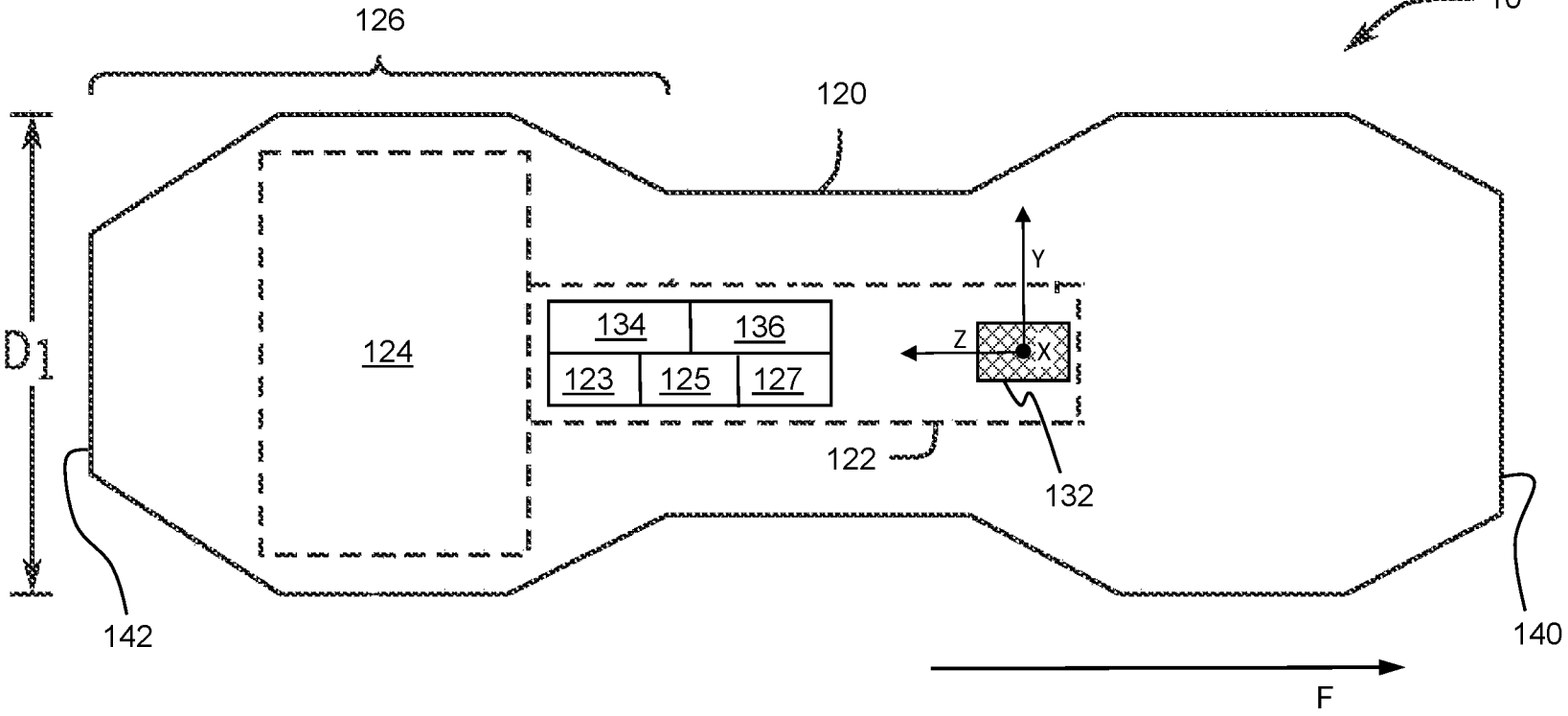
FIG. 2A is a schematic axial cross-sectional view of a dart according to an embodiment of the present disclosure.

A sample embodiment of dart 10 is shown in FIG. 2A. In the illustrated embodiment, dart 10 comprises a body 120, a control module 122, an actuation mechanism 124. The body 120 has an engagement section 126. The body 120 has a leading end 140 and a trailing end 142 between which the actuation mechanism 124, the engagement section 126, and the control module 122 are positioned. The body 120 is configured to allow the dart, including the engagement section 126, to travel freely through the passageway 30 and the features 40 therein when the dart 10 is in the inactivated position. In its inactivated position, the dart 10 has a largest outer diameter $D_1$ that is less than the inner diameter of the features 40 to allow the dart 10 to pass therethrough. When the dart 10 is in the activated position, the engagement section 126 is transformed by the actuation mechanism 124 for the purpose of, for example, causing the next encountered tool (i.e., the target tool) to engage the engagement section 126 to catch the dart 10. For example, when activated, the engagement section 126 is deployed to have an outer diameter that is greater than $D_1$ and the inner diameter of a seat in the target tool.

In some embodiments, the control module 122 comprises a controller 123, a memory module 125, and a power source 127 (for providing power to one or more components of the dart 10). In some embodiments, the control module 122 comprises one or more of: a magnetometer 132, an accelerometer 134, and a gyroscope 136, the functions of which will be described in detail below.

In some embodiments, the controller 123 comprises one or more of: a microcontroller, microprocessor, field programmable gate array (FPGA), or central processing unit (CPU), which receives feedback as to the dart's position and generates the appropriate signal(s) for transmission to the actuation mechanism 124. In some embodiments, the controller 123 uses a microprocessor-based device operating under stored program control (i.e., firmware or software stored or imbedded in program memory in the memory module) to perform the functions and operations associated with the dart as described herein. According to other embodiments, the controller 123 may be in the form of a programmable device (e.g. FPGA) and/or dedicated hardware circuits. The specific implementation details of the above-mentioned embodiments will be readily within the understanding of one skilled in the art. In some embodiments, the controller 123 is configured to execute one or more software, firmware or hardware components or functions to perform one or more of: analyze acceleration data and gyroscope data; calculate distance using acceleration data and gyroscope data; and analyze magnetic field and/or flux signals to detect, identify, and/or recognize a feature 40 in the tubing string based on physical contact with the feature and/or proximity to the feature.

In some embodiments, the dart 10 is programmable to allow an operator to select a target location downhole at which the dart is to self-activate. The dart 10 is configured such that the controller 123 can be enabled and/or preprogrammed with the target location information during manufacturing or on-site by the operator prior to deployment into the well. In some embodiments, the dart 10 may be preprogrammed during manufacturing and subsequently reprogrammed with different target location information on site by the operator. In some embodiments, the control module 122 is configured with a communication interface, for example, a port for connecting a communication cable or a wireless port (e.g. Radio Frequency or RF port) for receiving (transmitting) radio frequency signals for programming or configuring the controller 123 with the target location information. In some embodiments, where the controller 123 is disposed within an RF shield enclosure such as an aluminum and/or magnesium enclosure, modulation of magnetic field, sound, and/or vibration of the enclosure can be used to communicate with the controller 123 to program the target location. In some embodiments, the control module 122 is configured with a communication interface that is coupled (wireless or cable connection) to an input device (e.g., computer, tablet, smart phone or like) and/or includes a user interface that queries the operator for information and processes inputs from the operator for configuring the dart and/or functions associated with the dart or the control module. For example, the control module 122 may be configured with an input port comprising one or more user settable switches that are set with the target location information. Other configurations of the control module 122 are possible.

In some embodiments, the target location information comprises a specific number of features 40 in the tubing string 24 through which the dart 10 passes prior to self-activation. For example, dart 10 may be programmed with target location information specifying the number "five" so the dart remains inactivated until the controller 123 registers five counts, indicating that the dart has passed through five features 40, and the dart self-activates before reaching the next (sixth) feature in its path. In this embodiment, the sixth feature is the target tool. In an alternative embodiment, the target location information comprises the actual feature number of the target tool in the tubing string. For example, if the target tool is the sixth feature in the tubing string, the dart 10 can be programmed with target location information specifying the number "six" and the controller 123 in this case is configured to subtract one from the number of the target location information and triggers the dart 10 to self-activate after passing through five features.

In some embodiments, the controller maintains a count of each registered feature (via an electronics-based counter, for example), and the count may be stored in memory 125 (a volatile or a non-volatile memory) of the dart 10. The controller 123 thus logs when the dart 10 passes a feature 40 and updates the count accordingly, thereby determining the dart's downhole position based on the count. When the dart 10 determines that the count (based on the number of features 40 registered) matches the target location information programmed into the dart, the dart self-activates.

In other embodiments, the target location information comprises a specific distance from surface E at which the dart 10 is to self-activate. For example, a dart may be programmed with target location information specifying a distance of "100 meters" so the dart remains inactivated until the controller 123 determines that the dart 10 has travelled 100 meters in the passageway 30. When the controller 123 determines that the dart has reached the target location, the dart 10 self-activates. In this embodiment, the target tool is the next tool in the dart's path after self-activation.

In some embodiments, the well map may be stored in the memory 125 and the controller 123 may reference the well map to help determine the real-time location of the dart.

Physical Contact

Figure 1B:
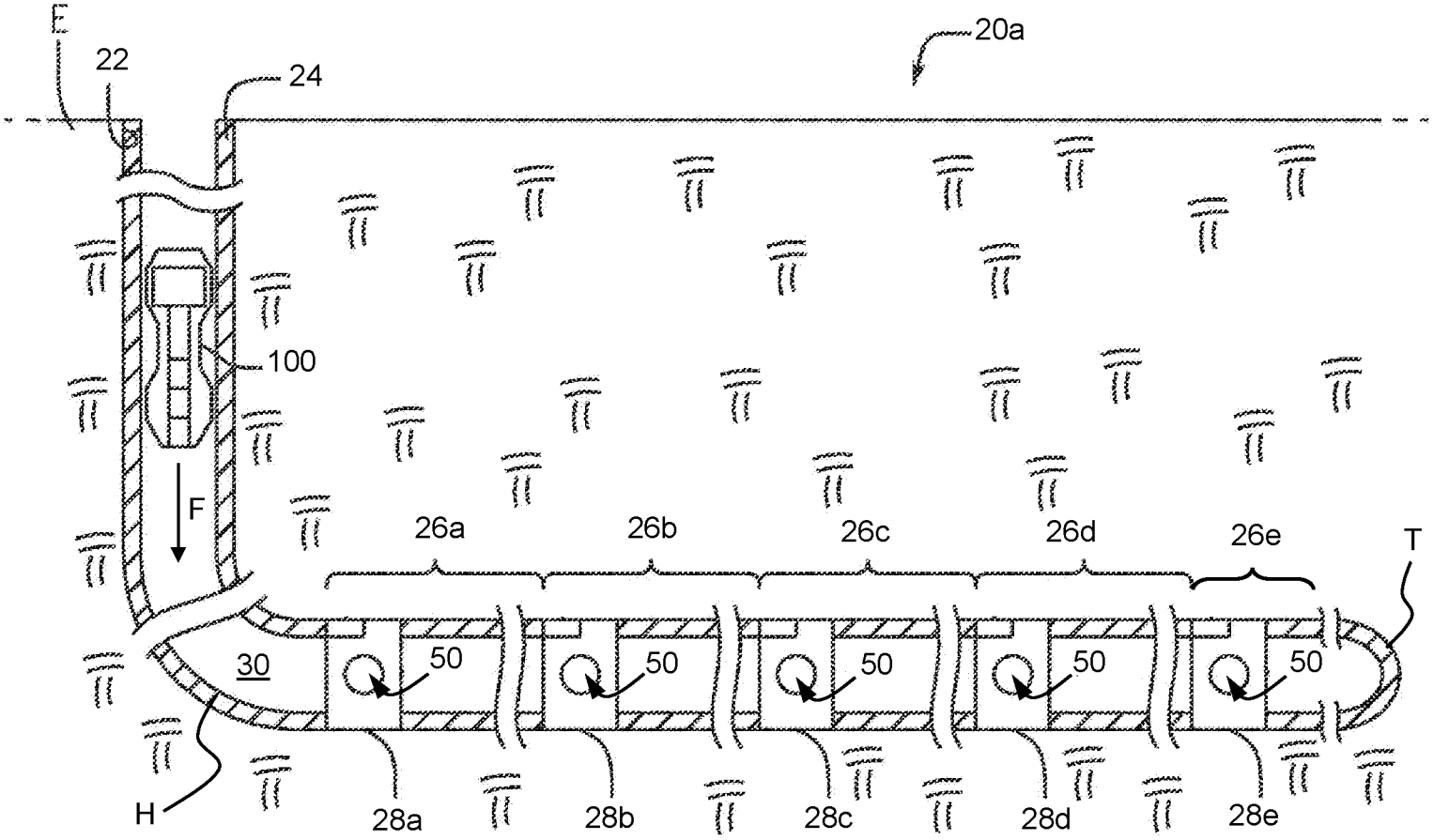
FIG. 1B is a schematic drawing of a multiple stage well according to another embodiment of the present disclosure, wherein the well comprises one or more constrictions.

FIG. 1B illustrates a multistage well 20*a* similar to the multistage well 20 of FIG. 1A, except at least one feature in each stage 26*a*,26*b*,26*c*,26*d*,26*e* of the well 20*a* is a constriction 50, i.e., an axial section that has a smaller inner diameter than that of the surrounding segments of the tubing string. The inner diameter of the constriction 50 is sized such that the dart, in its inactivated position, can pass therethrough but at least one part of the dart is in physical contact with the constriction 50 in order to pass therethrough. The inner diameter of each of the constrictions 50 may be substantially the same throughout the tubing string. In some embodiments, the constriction 50 may be a valve seat or a joint between adjacent segments of the tubing string or adjacent tools.

Figure 2B:
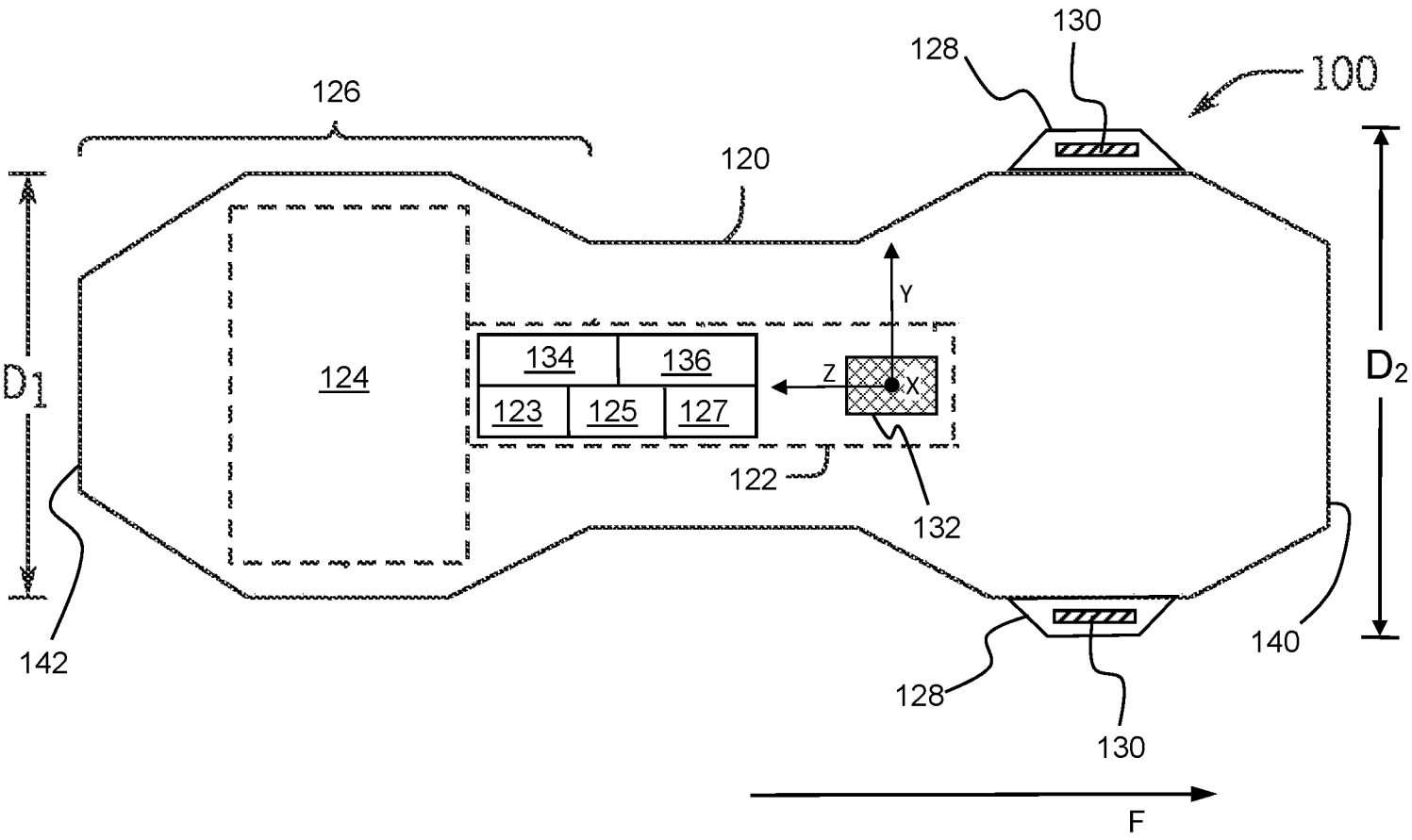
FIG. 2B is a schematic axial cross-sectional view of a dart according to another embodiment of the present disclosure, wherein the dart comprises protrusions.

FIG. 2B shows a sample embodiment of a dart 100 configured to physically contact one or more features in the passageway to determine the dart's downhole location in relation to a target location. Dart 100 has a body 120, a control module 122, an actuation mechanism 124, and an engagement section 126, which are the same as or similar to the like-numbered components described above with respect to dart 10 in FIG. 2A. With reference to both FIGS. 1B and 2B, in some embodiments, the dart 100 comprises one or more retractable protrusions 128 that are positioned on the body 120 to be acted upon, for example depressed, by a constriction 50 in the passageway 30 as the dart passes the constriction. In the illustrated embodiment, the protrusions 128 are shown in an extended (or undepressed) position wherein protrusions 128 extend radially outwardly from the outer surface of body 120 to provide an effective outer diameter $D_2$ that is greater than the largest outer diameter $D_1$ of the body 120 when the dart 100 is in the inactivated position. The largest outer diameter $D_1$ is less than the inner diameter of the constrictions 50 to allow the dart 100 to pass through the constrictions when the dart is inactivated. Dart 100 is configured such that outer diameter $D_2$ is slightly greater than the inner diameter of the constrictions 50 in the passageway 30. When the dart 100 travels through a constriction 50, the protrusions 128 are depressed by the inner surface of the constriction into a retracted position whereby the dart 100 can pass through the constriction 50 without hinderance. In embodiments, the protrusions 128 are spring-biased or otherwise configured to extend radially outwardly from the body 120 (i.e. the extended position), to retract when depressed by a constriction 50 when passing therethrough (i.e. the retracted position), and to recoil and re-extend radially outwardly from the body 120 after passing through a constriction back into the extended position. In some embodiments, the protrusions 128 allow the control module 122 to register and count each instance of the dart 100 passing a constriction 50, which will be described in more detail below.

The protrusions 128 are positioned on the body 120 somewhere between the leading end 140 and the trailing end 142. In embodiments, the leading end 140 has a diameter less than $D_1$ such that the dart 100 initially, easily passes through the constriction 50, allowing the dart 100 to be more centrally positioned and substantially coaxial with the constriction as protrusions 128 approach the constriction. While the protrusions 128 are shown in FIG. 2 to be spaced apart axially from the engagement section 126, it can be appreciated that in other embodiments the dart 100 may be configured such that protrusions 128 coincide or overlap with the engagement section 126.

In some embodiments, the dart 100 uses electronic sensing based on physical contact with one or more constrictions 50 in the passageway 30 to determine whether it has reached the target location. In this embodiment, each protrusion 128 has a magnet 130 embedded therein and the control module 122 is configured to detect changes in the magnetic fields and/or flux associated with magnets 130 that are caused by movement of the magnets.

In some embodiments, magnets 130 may be made from a material that is magnetized and creates its own persistent magnetic field. In some embodiment, the magnets 130 may be permanent magnets formed, at least in part, from one or more ferromagnetic materials. Suitable ferromagnetic materials useful with the magnets 130 described herein may include, for example, iron, cobalt, rare-earth metal alloys, ceramic magnets, alnico nickel-iron alloys, rare-earth magnets (e.g., a Neodymium magnet and/or a Samarium-cobalt magnet). Various materials useful with the magnets 130 may include those known as Co-netic AA®, Mumetal®, Hipernon®, Hy-Mu-80®, Permalloy®, each of which comprises about 80% nickel, 15% iron, with the balance being copper, molybdenum, and/or chromium. In the embodiment described with respect to FIGS. 2 and 3, magnet 130 is a rare-earth magnet. Each of magnets 130 may be of any shape including, for example, a cylinder, a rectangular prism, a cube, a sphere, a combination thereof, or an irregular shape. In some embodiments, all of the magnets in dart 100 are substantially identical in shape and size.

In the embodiment illustrated in FIGS. 2B and 3, the control module 122 comprises the magnetometer 132, which may be a three-axis magnetometer that is configured to detect the magnitude of magnetic flux in three axes, i.e., the x-axis, the y-axis, and the z-axis. A three-axis magnetometer is a device that can measure the change in anisotropic magnetoresistance caused by an external magnetic field. Using a magnetometer to measure magnetic field and/or flux allows directional and vector-specific sensing. Further, since it does not operate under the principles of Lenz's law, a magnetometer does not require movement to measure magnetic field and/or flux. A magnetometer can detect magnetic field even when it is stationary. In some embodiments, as best shown in FIG. 3, the magnetometer 132 is positioned at or about the central longitudinal axis of the dart 100 such that the magnetometer's z-axis is substantially parallel to the direction of travel of the dart (i.e., direction F). In the illustrated embodiment, the x-axis and the y-axis of the magnetometer are substantially orthogonal to direction F, and the x-axis and y-axis are substantially orthogonal to the z-axis and to one another. In the illustrated embodiment, the y-axis is substantially parallel to the direction in which the magnets 130 are moved as the protrusions 128 are being depressed. In further embodiments, the magnetometer 132 is positioned substantially equidistance from each of the magnets 130 when the protrusions 128 are not depressed.

While the dart 100 may operate with only one protrusion 128, the dart in some embodiments may comprise two or more protrusions 128 azimuthally spaced apart on the dart's the outer surface, at about the same axial location of the dart's body 120, to provide corroborating data in order to help the controller 123 differentiate the dart's passage through a constriction 50 versus a mere irregularity in the passageway 30. For example, when the dart passes through a constriction 50, the depression of the two or more protrusions 128 occurs almost simultaneously so the controller 123 registers the incident as a constriction because all the protrusions are depressed at about the same time. In contrast, when the dart passes an irregularity (e.g. a bump or impact) on the inner surface of the tubing string, only one or two of the plurality of protrusions may be depressed, so the controller 123 does not register the incident as a constriction 50 because not all of the protrusions are depressed at about the same time. Accordingly, the inclusion of multiple protrusions 128 in the dart may help the controller 123 differentiate irregularities in the passageway from actual constrictions.

With reference to the sample embodiment shown in FIGS. 2B and 3, dart 100 has two protrusions 128, each having a magnet 130 embedded therein. The magnets 130 are azimuthally spaced apart by about 180° and are positioned at about the same axial location on the body 120 of the dart 100. Each magnet 130 is a permanent magnet having two opposing poles: a north pole (N) and a south pole (S), and a corresponding magnetic field M. In some embodiments, the magnets 130 in the dart 100 are positioned such that the same poles of the magnets 130 face one another. For example, as shown in the illustrated embodiment, magnets 130 are positioned in dart 100 such that the north poles N of the magnets face radially inwardly, while the south poles S of the magnets 130 face radially outwardly. In other embodiments, the north poles N may face radially outwardly while the south poles S face radially inwardly. It can be appreciated that, in other embodiments, dart 100 may have fewer or more protrusions and/or magnets and each protrusion may have more than one magnet embedded therein, and other pole orientations of the magnets 130 are possible.

Figure 3A:
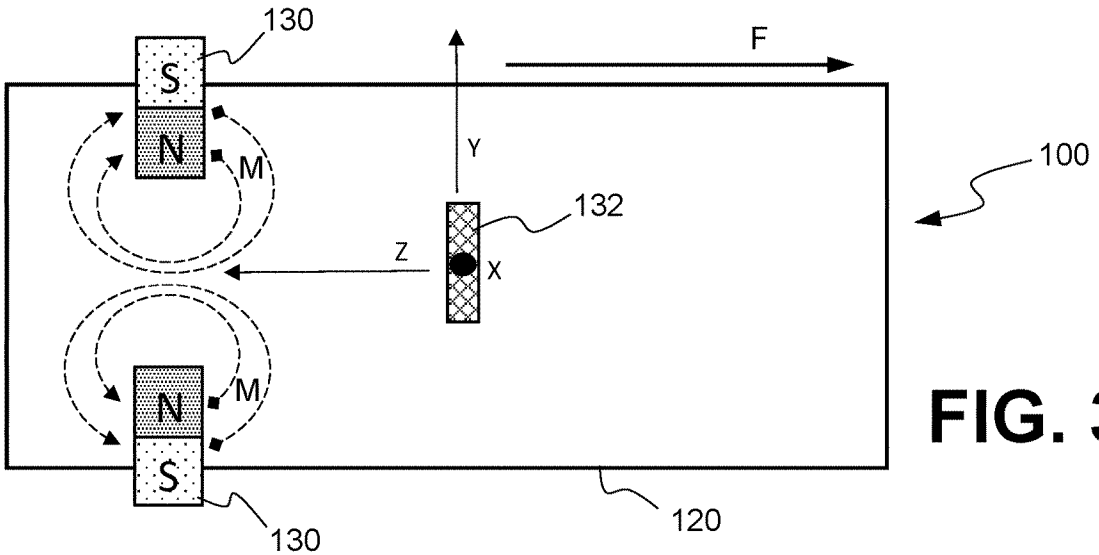
FIG. 3A is a schematic axial cross-sectional view of a dart according to one embodiment of the present disclosure, illustrating magnets in the dart and their corresponding magnet fields. Some parts of the dart in FIG. 3A are omitted for simplicity.
Figure 3B:
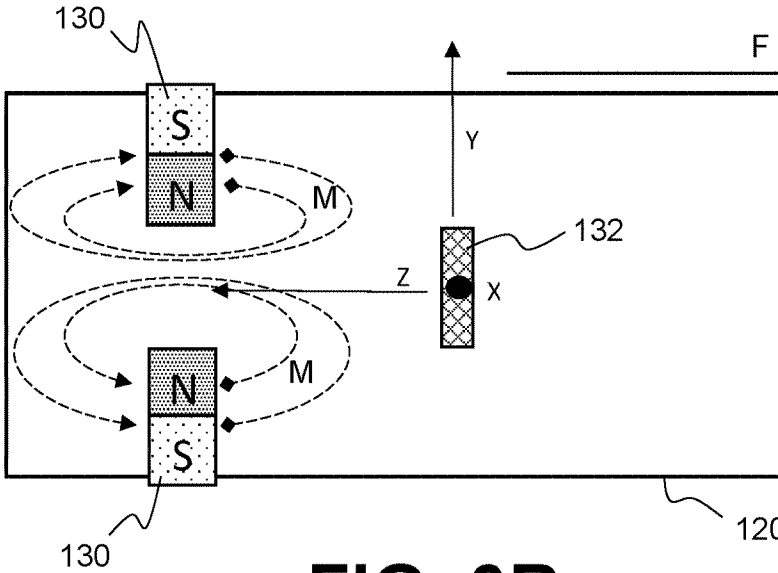
FIGS. 3B and 3C are a schematic axial cross-sectional view and a schematic lateral cross-sectional view, respectively, of the dart shown in FIG. 3A, illustrating magnetic fields of the magnets in the dart when the magnets are in a different position than that of the magnets in the dart of FIG. 3A.
Figure 3C:
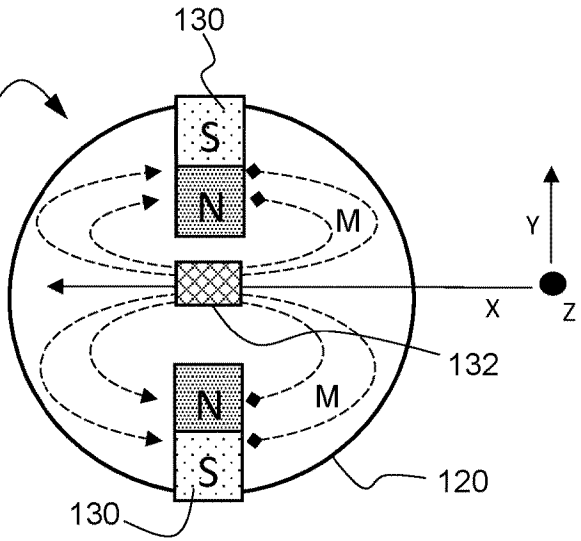

FIG. 3A shows the positions of the magnets 130 relative to one another when the protrusions (in which at least a portion of the magnets are disposed) are in the extended position where the protrusions are not depressed. FIGS. 3B and 3C show the positions of the magnets 130 relative to one another when the protrusions are in the retracted position where the protrusions are depressed, for example, by a constriction 50. Some parts of the dart 100 are omitted in FIG. 3 for clarity.

With reference to FIGS. 2B and 3, when the protrusions 128 are depressed and the magnets 130 therein are moved by some distance radially inwardly (as shown for example in FIGS. 3B and 3C), the movement of the magnets 130 changes the gradient of the vector of the magnetic field inside the dart 100. When the relative positions of the magnets 130 change, the magnetic fields M associated with the magnets 130 also change. For example, as the protrusions 128 and the magnets 130 therein move from the extended position (FIG. 3A) to the retracted position (FIGS. 3B and 3C), the positions of the magnets 130 change relative to one another (i.e., the distance between magnets 130 is decreased). In the illustrated embodiment shown in FIGS. 3B and 3C, the north poles N of the magnets 130 are closer to each other when the protrusions are depressed. The shortened distance between the magnets 130 causes the corresponding magnetic fields M to change, which in this case, to distort. The change (e.g., the distortion) of the magnetic fields of magnets 130 can be detected by measuring magnetic flux in each of the x-axis, y-axis, and z-axis using the magnetometer 132.

Based on the magnetic flux detected by the magnetometer 132, the magnetometer can generate one or more signals. In some embodiments, the controller 123 is configured to process the signals generated by the magnetometer 132 to determine whether the changes in magnetic field and/or magnetic flux detected by the magnetometer 132 are caused by a constriction 50 and, based on the determination, the controller 123 can determine the dart's downhole location relative to the target location and/or target tool by counting the number of constrictions 50 that the dart has encountered and/or referencing the known locations of the constrictions 50 in the well map of the tubing string with the counted number of constrictions. In some embodiments, the controller 123 uses a counter to maintain a count of the number of constrictions the controller registers.

Figure 4:
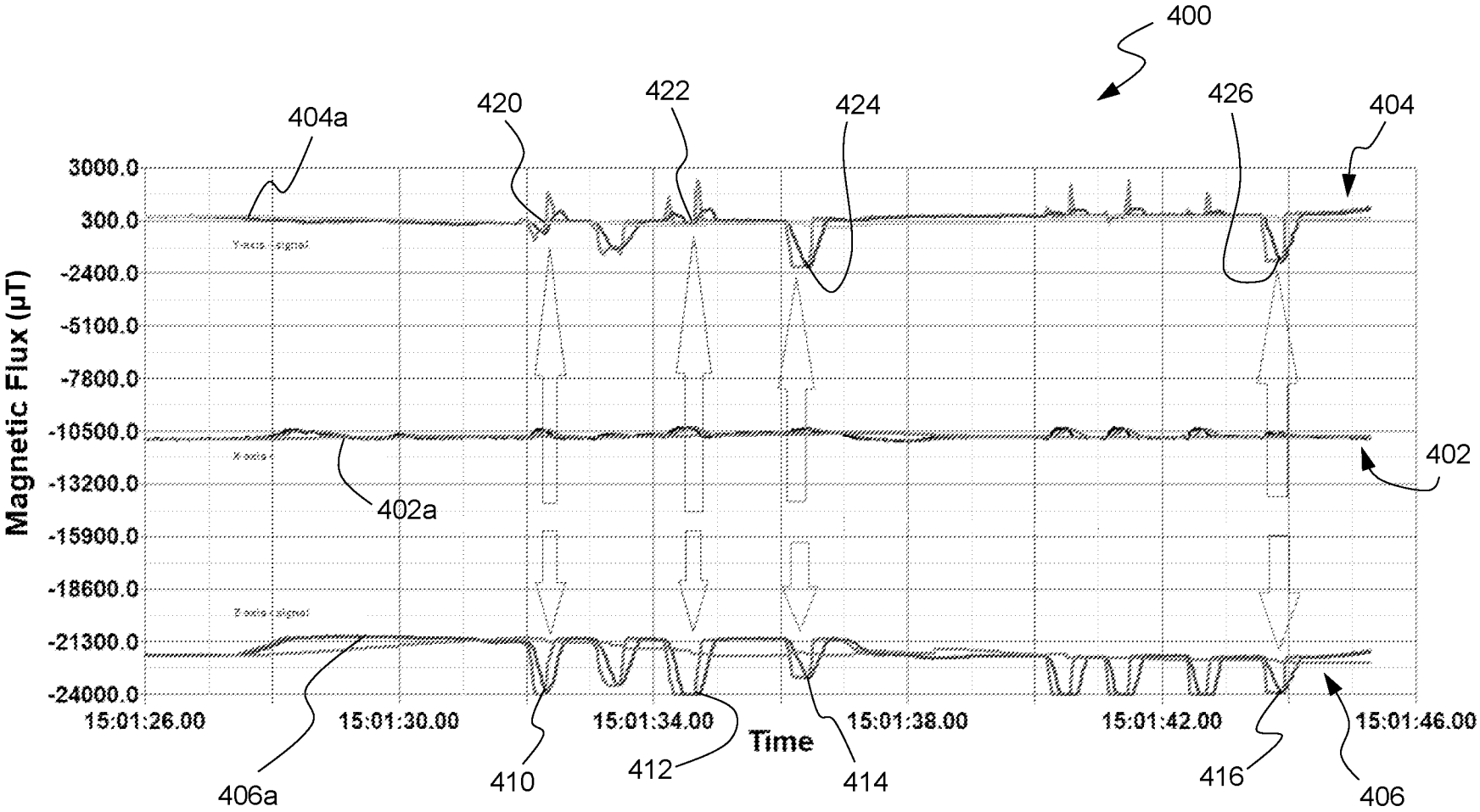
FIG. 4 is a sample graphical representation of the x-axis, y-axis, and z-axis components of magnetic flux over time, as measured by a magnetometer of a dart, as the dart is travelling through a passageway, according to one embodiment of the present disclosure.

FIG. 4 shows a sample plot 400 of signals generated by the magnetometer 132. In plot 400, the x-axis, the y-axis, and the z-axis components of the magnetic flux measured over time as the dart 100 is traveling down the tubing string are represented by lines 402,404,406, respectively, and they correspond respectively to the x-axis, y-axis, and z-axis directions indicated in FIG. 3. In some embodiments, the magnetometer 132 continuously measures the magnetic flux components in the three axes as the dart 100 travels. When the dart 100 moves freely in the passageway without any interference, the magnetometer 132 detects a baseline magnetic flux 402*a*,404*a*,406*a* in each of the x-axis, y-axis, and z-axis, respectively. In the illustrated embodiment, the baseline 402*a* of the x-axis component is about −10500.0 μT; the baseline 404*a* of the y-axis component is about 300.0 μT; and the baseline 406*a* of the z-axis component is about −21300.0 μT. In some embodiments, each of the x-axis, y-axis, and z-axis components 402,404,406 of the magnetic flux detected by the magnetometer 132 can provide the controller 123 with a different type of information.

In one example, a change in magnitude of the z-axis component 406 of the magnetic flux from the baseline 406*a* may indicate the dart's passage through a constriction 50. In some embodiments, the z-axis component 406 is associated with the distance by which the magnets 130 are moved, which helps the controller 123 determine, based on the magnitude of the detected magnetic flux relative to the baseline 406*a*, whether the change in magnetic flux in the z-axis is caused by a constriction 50 or merely an irregularity (e.g. a random impact or bump) in the tubing string.

In another example, the y-axis component 404 of the detected magnetic flux may help the controller 123 distinguish the passage of the dart 100 through a constriction 50 from mere noise downhole. In some embodiments, the y-axis component 404 helps the controller 123 identify and disregard signals that are caused by asymmetrical magnetic field fluctuations. Asymmetrical magnetic field fluctuations occur when the protrusions are not depressed almost simultaneously, which likely happens when the dart 100 encounters an irregularity in the passageway. When the magnetic field fluctuation is asymmetrical, the detected magnetic flux in the y-axis 404 deviates from the baseline 404*a*. In contrast, when the dart 100 passes through a constriction, wherein all the protrusions are depressed almost simultaneously such that the radially inward movements of magnets 130 are substantially synchronized, the resulting magnetic field fluctuation of the magnets 130 is substantially symmetrical. When the resulting magnetic field fluctuation is substantially symmetrical, the y-axis component of the measured magnetic flux 404 is the same as or close to the baseline 404*a*, because the distortion of the magnetic fields of magnets 130 substantially cancels out one another in the y-axis.

Together, the z-axis and y-axis components 406,404 provide the information necessary for the controller 123 to determine whether the dart 100 has passed a constriction 50 rather than just an irregularity in the passageway. Based on the change in magnetic flux detected in the z-axis and the y-axis relative to baseline values 406*a*,404*a*, the controller 123 can determine whether the magnets 130 have moved a sufficient distance, taking into account any noise downhole (e.g. asymmetrical magnetic field fluctuations), to qualify the change as being caused by a constriction rather than an irregularity.

In some embodiments, the x-axis component 402 of the detected magnetic flux is not attributed to the movement of the magnets 130 but rather to any residual magnetization of the materials in the tubing string. Residual magnetization has a similar effect on the y-axis component 404 of the magnetic flux and may shift the y-axis component out of its detection threshold window. By monitoring the x-axis component 402, the controller 123 can use the x-axis component signal to dynamically adjust the baseline 404*a* of the y-axis component to compensate for the effects of residual magnetization and/or to correct any magnetic flux reading errors related to residual magnetization.

In some embodiments, controller 123 monitors the magnetic flux signals to identify the dart's passage through a constriction 50. With specific reference to FIG. 4, a change in magnetic flux in the z-axis component 406 relative to the baseline 406*a* can be detected by the magnetometer when at least one of the magnets 130 moves in the y-axis direction as shown in FIG. 3, i.e., when at least one of the protrusions is depressed, and such a change in z-axis magnetic flux is shown for example by pulses 410, 412, 414, and 416. When a change in the z-axis component is detected, the controller 123 checks whether the y-axis component 404 of the magnetic flux is at or near the baseline 404*a* when the change in the z-axis is at its maximum value (i.e., the peak or trough of a pulse in the z-axis signal, for example, the amplitude of pulses 410, 412, 414, and 416 in FIG. 4) to determine if both protrusions are depressed substantially simultaneously, as described above. In some embodiments, the controller 123 may only check the y-axis magnetic flux signal 404 if the maximum of a z-axis pulse is greater than a predetermined threshold magnitude. The controller 123 may disregard any change in the z-axis magnetic flux signal below the predetermined threshold magnitude as noise.

Points 420 and 422 in FIG. 4 are examples of baseline readings of the y-axis component 404 of the detected magnetic flux that occur at substantially the same time as the maximum of a z-axis pulse (i.e., points 410 and 412, respectively). A "baseline reading" in the y-axis component refers to a signal that is at the baseline 404*a* or close to the baseline 404*a* (i.e., within a predetermined window around the baseline 404*a*). It is noted that the positive or negative change in the y-axis magnetic flux 404 detected immediately prior to or after the baseline readings 420,422 may be caused by one or more protrusions being depressed just before the other protrusion(s) as the dart 100 may not be completely centralized in the passageway as it is passing through the constriction.

In some embodiments, when the maximum of a pulse in the z-axis signal coincides with a baseline reading in the y-axis signal (e.g. the combination of point 420 in the y-axis signal 404 and the trough of pulse 410 in the z-axis signal 406; and the combination of point 422 in the y-axis signal 404 and the trough of pulse 412 in the z-axis signal 406), the controller 123 can conclude that the dart 100 has passed through a constriction 50. In some embodiments, where a baseline reading in the y-axis substantially coincides with a change in magnetic flux detected in the z-axis, the controller 123 may be configured to qualify the baseline reading only if the baseline reading lasts for at least a predetermined threshold timespan (for example, 10 μs) and disqualifies the baseline reading as noise if the baseline reading is shorter than the predetermined period of time. This may help the controller 123 distinguish between noise and an actual reading caused by the dart's passage through a constriction.

When the dart 100 passes through an irregularity in the passageway instead of a constriction 50, often only one protrusion is depressed, which results in a magnetic field fluctuation that is asymmetrical. Such an event is indicated by a change in z-axis magnetic flux signal 406, as shown for example by each of pulses 414 and 416, which coincides with a positive or negative change the y-axis magnetic flux 404 relative to the baseline 404*a*, as shown for example by each of pulses 424 and 426, respectively. Therefore, when the controller 123 detects a change in the z-axis magnetic flux relative to baseline 406*a* but also sees a substantially simultaneous deviation of the y-axis magnetic flux from baseline 404*a* beyond the predetermined window, the controller 123 can ignore such changes in the y-axis and z-axis signals and disregard the event as noise.

Figure 13:
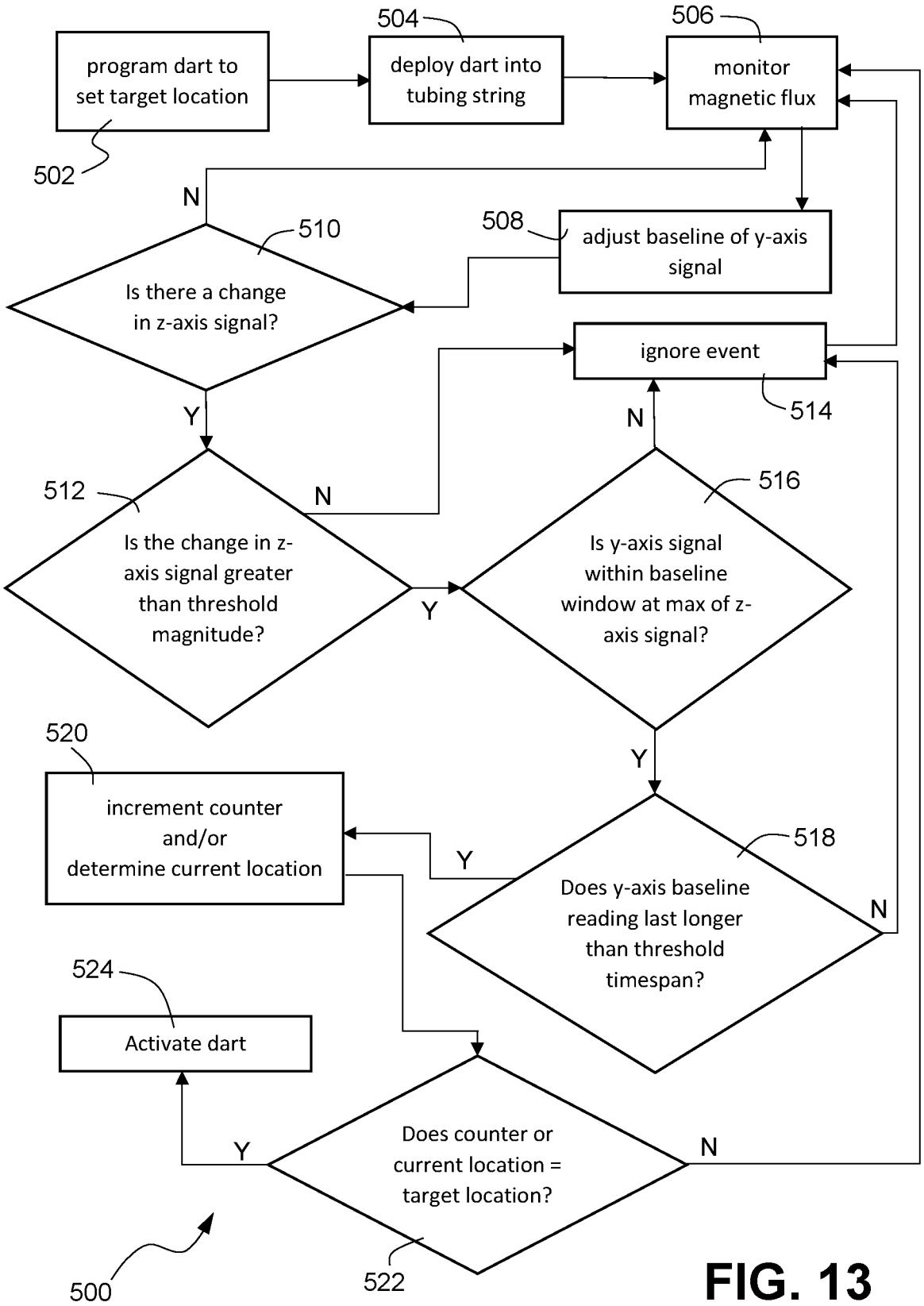
FIG. 13 is a flowchart of a method of determining a location of a dart in a wellbore, according to one embodiment.

FIG. 13 is a flowchart illustrating a sample process 500 for determining the real-time location of the dart 100 via physical contact, according to one embodiment. At step 502, the controller 123 of dart 100 is programmed with the desired target location, which may be a number or a distance. At step 504, the dart 100 is deployed into the tubing string. At step 506, as the dart 100 travels down the tubing string, the magnetometer 132 continuously measures the magnetic flux in the x-axis, the y-axis, and the z-axis and sends signals of same to the controller 123 so that the controller 123 can monitor the magnetic flux in all three axes.

In some embodiments, at step 508, the controller 123 uses the x-axis signal of the detected magnetic flux to adjust the baseline of the y-axis signal, as described above. At step 510, the controller 123 continuously checks for a change in the z-axis magnetic flux signal. If there is no change in the z-axis signal, the controller continues to the monitor the magnetic flux signals (step 506). If there is a change in the z-axis signal, the controller 123 compares the change with the predetermined threshold magnitude (step 512). If the change in the z-axis signal is below the threshold magnitude, the controller 123 ignores the event (step 514) and continues to monitor the magnetic flux signals (step 506).

If the change in the z-axis signal is at or above the threshold magnitude, the controller 123 checks whether y-axis signal is a baseline reading (i.e., the y-axis signal is within a predetermined baseline window) when the change in z-axis signal pulse is at its maximum (step 516). If the y-axis signal is not within the baseline window, the controller 123 ignores the event (step 514) and continues to monitor the magnetic flux signals (step 506). If the y-axis signal is within the baseline window, the controller 123 checks if the y-axis baseline reading lasts for at least the threshold timespan (step 518). If the y-axis baseline reading lasts less than the threshold timespan, the controller 123 ignores the event (step 514) and continues to monitor the magnetic flux signals (step 506). If the y-axis baseline reading lasts for at least the threshold timespan, the controller 123 registers the event as the passage of a constriction 50 and increments (e.g., adds one to) the counter (step 520). At step 520, the controller 123 may also determine the current downhole location of the dart based on the number of the counter and the known locations of the constrictions 50 on the well map.

The controller 123 then proceeds to step 522, where the controller 123 checks whether the updated counter number or the determined current location of the dart has reached the preprogrammed target location. If the controller determines that the dart has reached the target location, the controller 123 sends a signal to the actuation mechanism 124 to activate the dart 100 (step 524). If the controller determines that the dart has not yet reached the target location, the controller 123 continues to monitor the magnetic flux signals (step 506).

Ambient Sensing

In some embodiments, no physical contact is required for a dart to monitor its location in the passageway 30. As the dart travels through the tubing string, the magnetic field in the around the dart changes due to, for example, residual magnetization in the tubing string, variations in thickness of the tubing string, different types of formations traversed the tubing string (e.g., ferrite soil), etc. In some embodiments, by monitoring the change in magnetic field in the dart's surroundings, the downhole location of the dart can be determined in real-time.

Figure 1C:
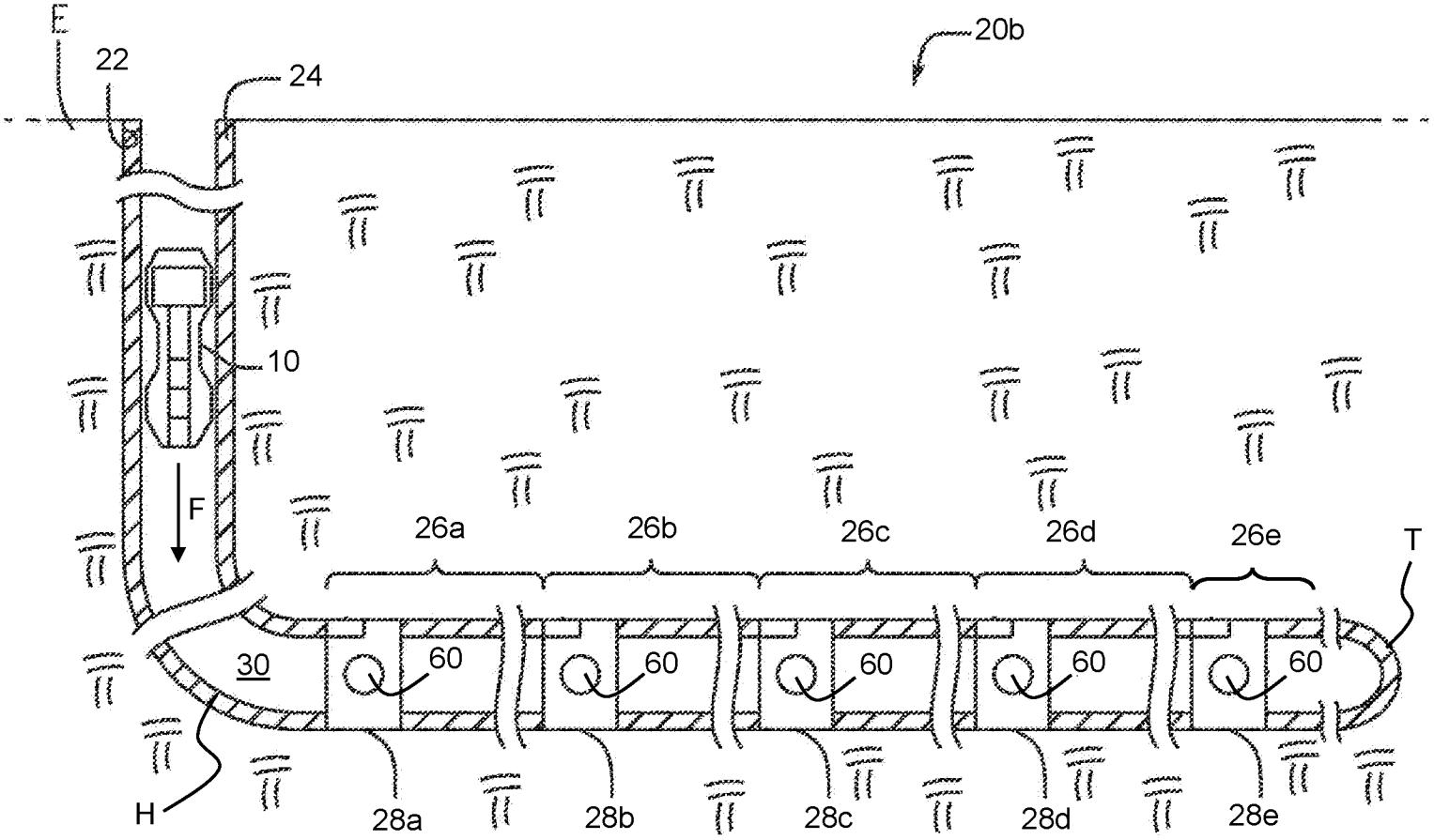
FIG. 1C is a schematic drawing of a multiple stage well according to yet another embodiment of the present disclosure, wherein the well comprises one or more magnetic features.

FIG. 1C illustrates a multistage well 20*b* similar to the multistage well 20 of FIG. 1A, except at least one feature in each stage 26*a*,26*b*,26*c*,26*d*,26*e* of the well 20*b* is a magnetic feature 60. A magnetic feature 60 comprises ferromagnetic material or is otherwise configured to have different magnetic properties than those of the surrounding segments of the tubing string 24. A "different" magnetic property may refer to a weaker magnetic field (or other magnetic property) or a stronger magnetic field (or other magnetic property). In one example, a magnetic feature 60 may comprise a magnet to render the magnetic property of that magnetic feature 60 different than those of the surrounding tubing segments. In another example, magnetic features 60 may include "thicker" features in the tubing string 24 such as joints, since joints are usually thicker than the surrounding segments and thus contain more metallic material than the surrounding segments. Tubing string joints are spaced apart by a known distance, as they are intermittently positioned along the tubing string 24 to connect adjacent tubing segments. In yet another example, a magnetic feature 60 may include any of tools 28*a*,28*b*,28*c*,28*d*,28*e* because a tool may contain more metallic material (i.e., tools may have thicker metallic materials than their surrounding segments) or be formed of a material having different magnetic properties than the surrounding segments of the tubing string.

In some embodiments, with reference to FIGS. 1C and 2A, the magnetometer 132 of dart 10 is configured to continuously sense the magnetometer's ambient magnetic field and/or magnetic flux as the dart 10 travels down the tubing string 24 and accordingly send one or more signals to the controller 123. While the dart 10 travels down the tubing string, the magnetic field and/or magnetic flux measured by the magnetometer 132 varies in strength due to the influence of the magnetic features 60 in the tubing string as the dart 10 approaches, coincides with, and passes each magnetic feature 60. In some embodiments, a magnet may be disposed in one or more of magnetic features 60 to help further differentiate the magnetic properties of the magnetic features 60 from those of the surrounding tubing string segments, which may enhance the magnetic field and/or flux detectable by the magnetometer 132.

Based on the signals generated by the magnetometer 132, the controller 123 detects and logs when the dart 10 nears a magnetic feature 60 in the tubing string so that the controller 123 may determine the dart's downhole location at any given time. For example, a change in the signal of the magnetometer may indicate the presence of a magnetic feature 60 near the dart 10. In some embodiments, the magnetometer 132 measures directional magnetic field and is configured to measure magnetic field in the x-axis direction and the y-axis direction as the dart 10 travels in direction F. In the illustrated embodiment shown in FIG. 2A, the magnetometer 132 is positioned at the central longitudinal axis of the dart 10, which may help minimize directional asymmetry in the measurement sensitivity of the magnetometer. The x-axis and the y-axis of the magnetometer 132 are substantially orthogonal to direction F and to one another.

In some embodiments, the magnetic field M of the environment around the magnetometer (the "ambient magnetic field") can be determined by:

$$M=\sqrt{(x+c)^2+(y+d)^2} \quad \text{(Equation 1)}$$

where x is the x-axis component of the magnetic field detected by the magnetometer 132, c is an adjustment constant for the x-axis component, y is the y-axis component of the magnetic field detected by the magnetometer 132, and d is an adjustment constant for the y-axis component. The purpose of constants c and d is to compensate for the effects of any component and/or materials in the dart on the magnetometer's ability to sense evenly in the x-y plane around the perimeter of the magnetometer. The values of constants c and d depend on the components and/or configuration of the dart 10 and can be determined through experimentation. When the appropriate constants c and d are used in Equation 1, the calculated ambient magnetic field M is independent of any rotation of the dart 10 about its central longitudinal axis relative to the tubing string 24 because any imbalance in measurement sensitivity between the x-axis and the y-axis of the magnetometer is taken into account. Considering only the x-axis and y-axis components of the magnetic field detected by the magnetometer when calculating the ambient magnetic field M may help reduce noise (e.g., minimize any influence of the z-axis component) in the calculated ambient magnetic field M.

The controller 123 interprets the magnetic field and/or magnetic flux signal provided by the magnetometer 132 in the x-axis and the y-axis to detect a magnetic feature 60 in the dart's environment as the dart 10 travels. In some embodiments, each magnetic feature 60 is configured to provide a magnetic field strength detectable by the magnetometer between a predetermined minimum value ("min M threshold") and a predetermined maximum value ("max M threshold"). Also, the magnetic strength and/or length of the magnetic feature 60 may be chosen such that, when dart 10 is travelling at a given speed in the tubing string, the magnetometer 132 can detect the magnetic field of the magnetic feature 60, at a value between the min M threshold and max M threshold, for a time period between a predetermined minimum value ("min timespan") and a predetermined maximum value ("max timespan"). For example, for a magnetic feature, the min M threshold is 100 mT, the max M threshold is 200 mT, the min timespan is 0.1 second, the max timespan is 2 seconds. Collectively, the min M threshold, max M threshold, min timespan, and max timespan of each magnetic feature 60 constitute the parameters profile for that specific magnetic feature.

When the dart 10 is not close to a magnetic feature 60, the magnitude of the magnetic field M determined by the controller 123 based on the x-axis and y-axis signals from the magnetometer 132 can fluctuate but is below the min M threshold. When the dart 10 approaches an object with a different magnetic property (e.g., a magnetic feature 60) in the tubing string, the magnitude of the detected magnetic field M changes and may rise above the min M threshold. In some embodiments, when the detected magnetic field M falls between the min M threshold and the max M threshold for a time period between the min timespan and max timespan, the controller 123 identifies the event as being within the parameters profile of a magnetic feature 60 and logs the event as the dart's passage through the magnetic feature 60. The controller 123 may use a timer to track the time elapsed while the magnetic field M stayed between the min and max M thresholds.

In some embodiments, all the magnetic features 60 in the tubing string 24 have the same parameters profile. In other embodiments, one or more magnetic features 60 have a distinct parameters profile such that when dart 10 passes through the one or more magnetic features 60, the change in magnetic field and/or magnetic flux detected by the magnetometer 132 is distinguishable from the change detected when the dart passes through other magnetic features in the tubing string. In some embodiments, at least one magnetic feature in the tubing string has a first parameters profile and at least one magnetic feature of the remaining magnetic features in the tubing string has a second parameters profile, wherein the first parameters profile is different from the second parameters profile.

By logging the presence of magnetic features 60 in the tubing string, the controller 123 can determine the downhole location of the dart in real-time, either by cross-referencing the detected magnetic features 60 with the known locations thereof on the well map or by counting the number of magnetic features (or the number of magnetic features with specific parameters profiles) dart 10 has encountered. In some embodiments, the counter of the controller 123 maintains a count of the detected magnetic features 60. The controller 123 compares the current location of dart 10 with the target location, and upon determining that the dart has reached the target location, the controller 123 signals the actuation mechanism 124 to transform the dart into the activated position.

Figure 14:
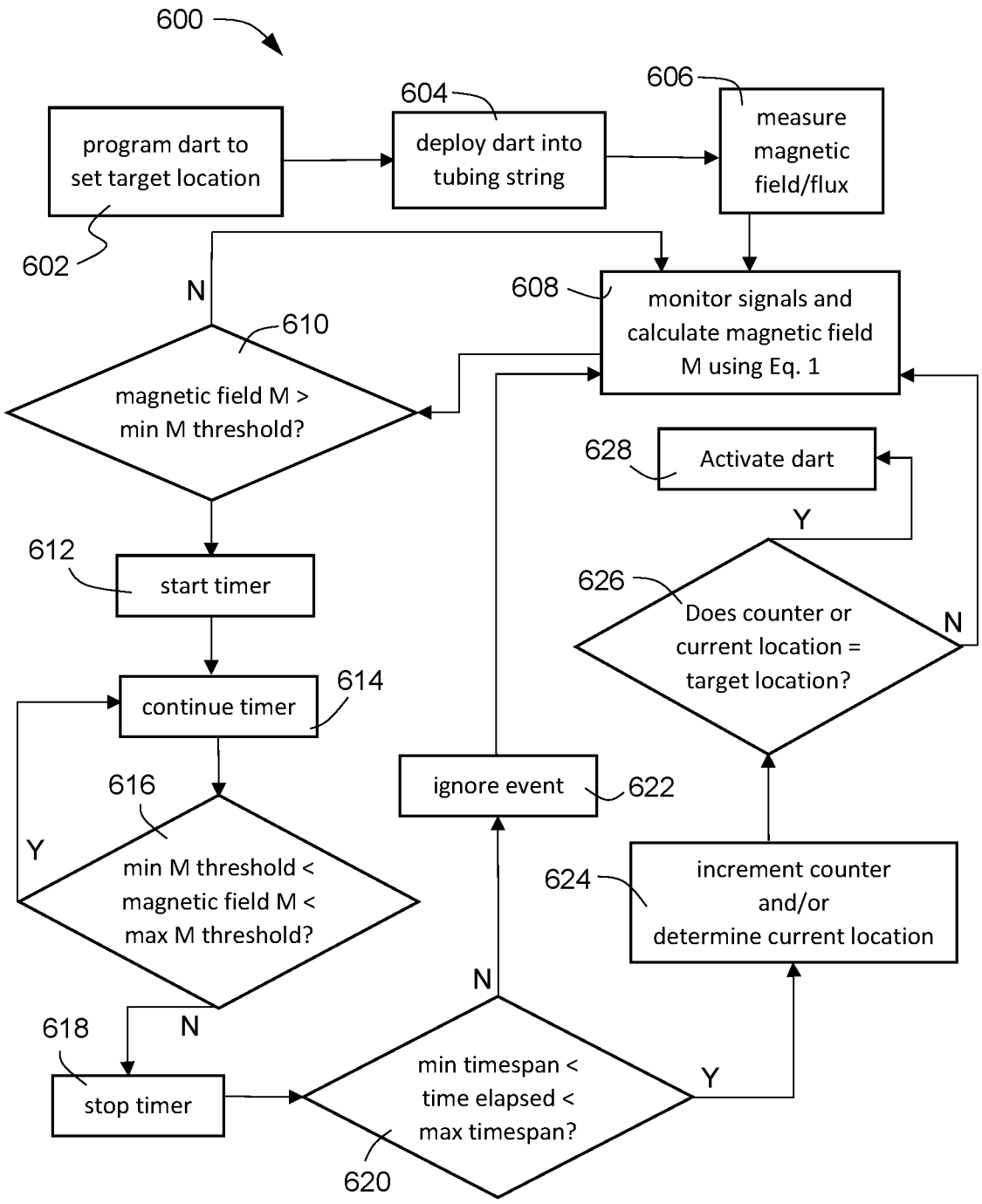
FIG. 14 is a flowchart of a method of determining a location of a dart in a wellbore, according to another embodiment.

FIG. 14 is a flowchart illustrating a sample process 600 for determining the downhole location of the dart 10 in multistage well 20*b*. At step 602, the dart 10 is programed with a desired target location. The dart 10 is then deployed in the tubing string (step 604). The magnetometer 132 of dart 10 continuously measures the magnetic field and/or flux in the x-axis, y-axis, and z-axis (step 606) and sends an x-axis signal, a y-axis signal, and (optionally) a z-axis signal to the controller 123. Based on at least the x-axis signal, the y-axis signal, and constants c and d, the controller 123 determines the ambient magnetic field M using Equation 1 above (step 608). If the dart 10 is not close to a magnetic feature, the magnitude of ambient magnetic field M may fluctuate but is generally below the min M threshold. As ambient magnetic field M is continuously updated based on the signals received from the magnetometer 132, the controller 123 monitors the real-time value of the ambient magnetic field M to see whether the ambient magnetic field M rises above the min M threshold (step 610).

If ambient magnetic field M remains below min M threshold, the controller 123 does nothing and continues to interpret the x-axis and y-axis signals from the magnetometer 132 (step 608). If ambient magnetic field M rises above the min M threshold, the controller 123 starts the timer (step 612). The controller 123 continues to run the timer (step 614) while monitoring the magnetic field M to check whether the real-time ambient magnetic field M is between the min M threshold and the max M threshold (step 616). If the ambient magnetic field M stays between the min M threshold and the max M threshold, the controller 123 continues to run the timer (step 614). If the ambient magnetic field M falls outside the min and max M thresholds, the controller 123 stops the timer (step 618). The controller 123 then checks whether the time elapsed between the start time of the timer at step 612 and the end time of the timer at step 618 is between the min timespan and the max timespan (step 620). If the time elapsed is not between the min and max timespans, the controller 123 ignores the event (step 622) and continues to monitor the magnetic field M (step 608). If the time elapsed is between the min and max timespans, the controller 123 registers the event as the dart's passage of a magnetic feature and increments the counter (step 624). At step 624, the controller 123 may also determine the current downhole location of the dart 10 based on the number of the counter and the known locations of the magnetic features on the well map.

The controller 123 then proceeds to step 626, where the controller 123 checks whether the updated counter number or the determined current location of the dart 10 has reached the preprogrammed target location. If the controller determines that the dart has reached the target location, the controller 123 sends a signal to the actuation mechanism 124 to activate the dart 10 (step 628). If the controller determines that the dart 10 has not yet reached the target location, the controller 123 continues to monitor the ambient magnetic field M (step 608).

Proximity Sensing

Figure 2C:
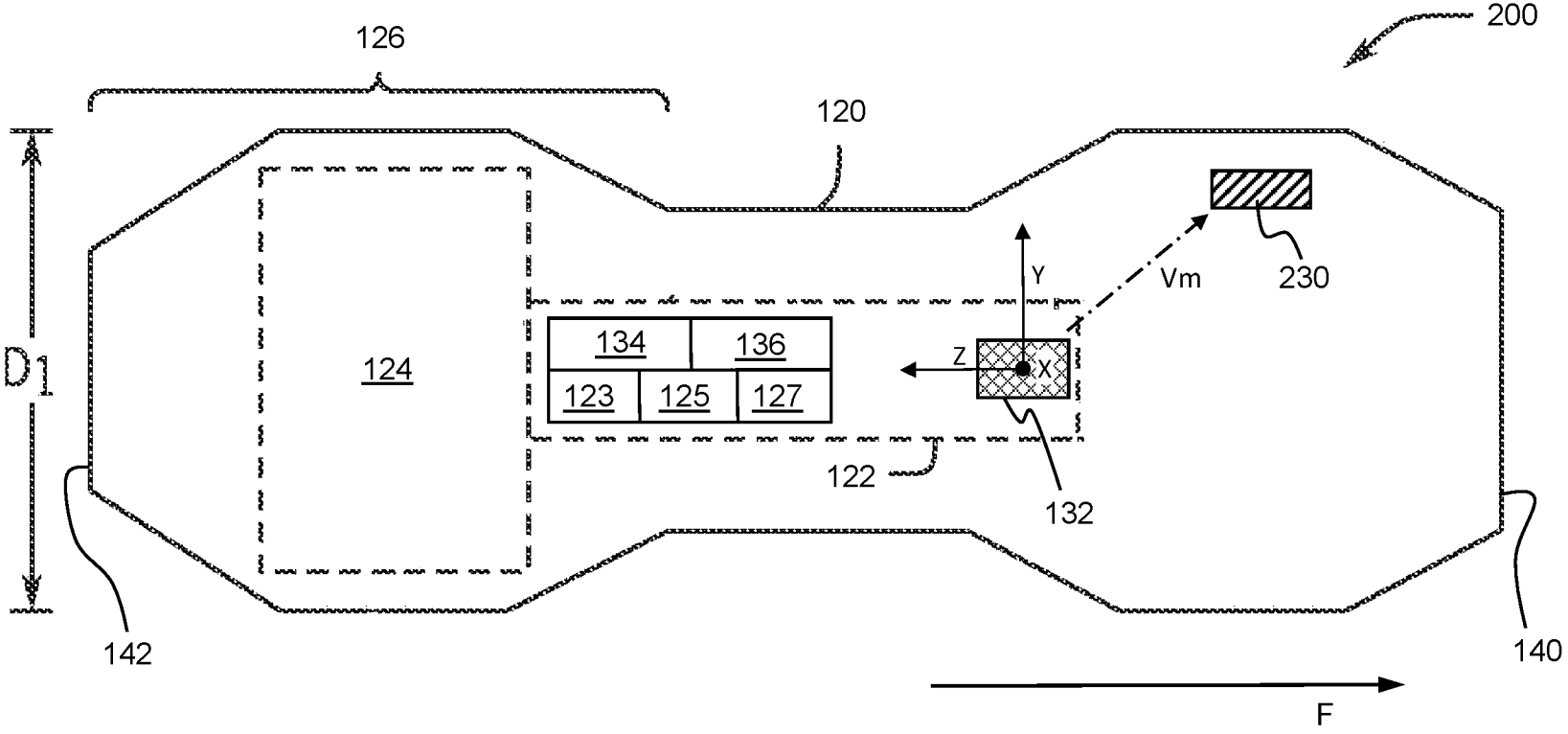
FIG. 2C is a schematic axial cross-sectional view of a dart according to yet another embodiment of the present disclosure, wherein the dart has a magnet embedded therein.

FIG. 2C shows a sample embodiment of a dart 200 configured to determine its downhole location in relation to a target location without physical contact with the tubing string. Dart 200 has a body 120, a control module 122, an actuation mechanism 124, and an engagement section 126, which are the same as or similar to the like-numbered components described above with respect to dart 10 in FIG. 2A. In some embodiment, the dart 200 comprises a magnet 230, and the magnet 230 may have the same or similar characteristics as those described above with respect to magnet 130 in FIG. 2B. In the illustrated embodiment, magnet 230 is embedded in the body 120 of the dart 200 and is rigidly installed in the dart such that the magnet 230 is stationary relative to the body 120 regardless of the motion of the dart.

Figure 1D:
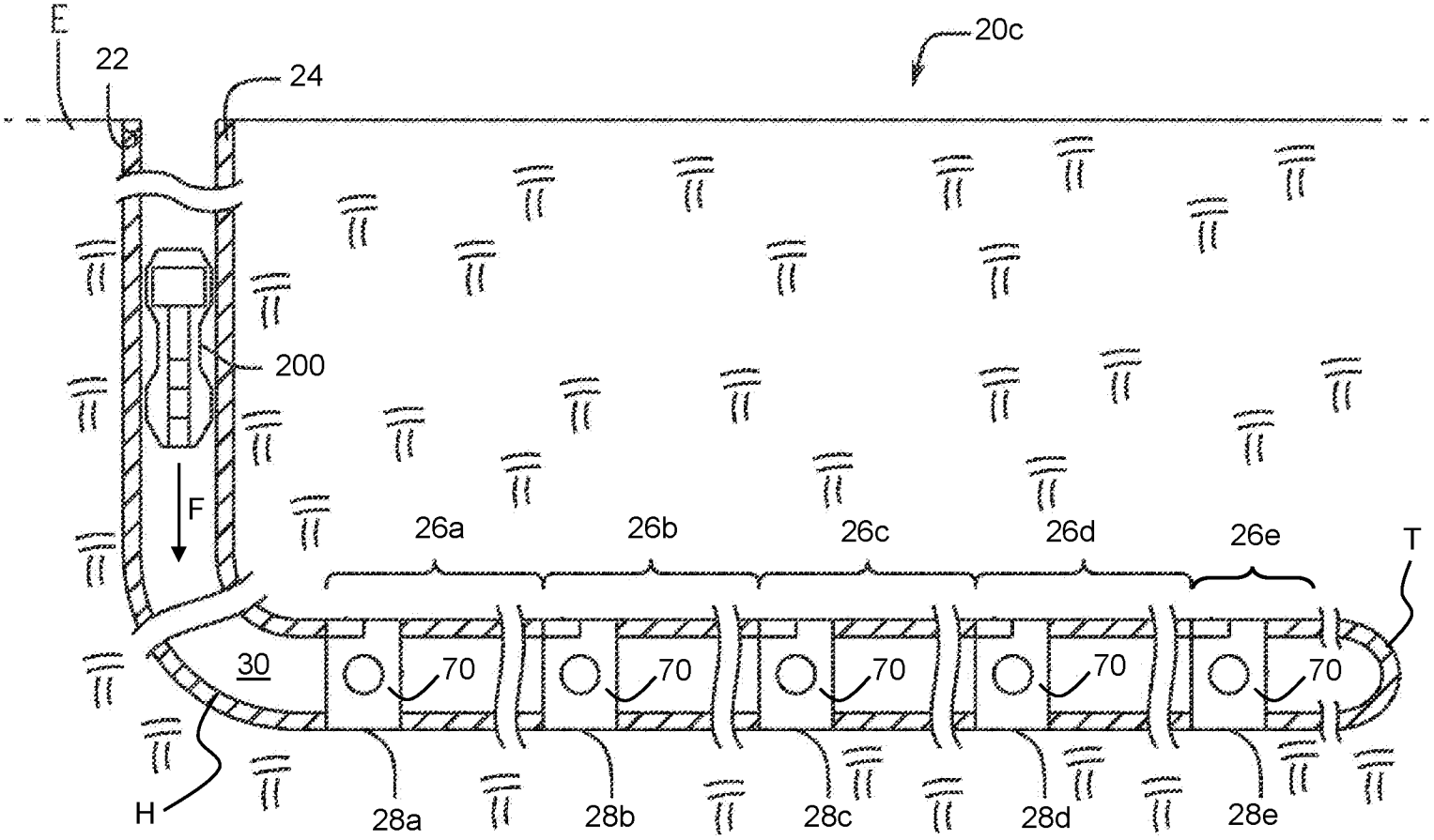
FIG. 1D is a schematic drawing of a multiple stage well according to yet another embodiment of the present disclosure, wherein the well comprises one or more thicker features.

FIG. 1D illustrates a multistage well 20*c* similar to the multistage well 20 of FIG. 1A, except at least one feature in each stage 26*a*,26*b*,26*c*,26*d*,26*e* of the well 20*c* is a thicker feature 70. The thicker features 70 are sections of increased thicknesses (or increased amounts of metallic material) in the tubing string 24, such as tubing string joints and/or any of tools 28*a*,28*b*,28*c*,28*d*,28*e*. The downhole location of features 70 is known via, for example, the well map prior to the deployment of the dart 200. In other embodiments, features 70 are magnetic features that are the same as or similar to magnetic features 60 described above with respect to FIG. 1C.

With reference to FIGS. 1D and 2C, the magnetometer 132 of dart 200 is configured to continuously measure the magnetic field and/or magnetic flux of the magnet 230 as the dart 200 travels down the tubing string 24 and accordingly send one or more signals to the controller 123. While the dart 200 travels down the tubing string, the strength of the magnetic field and/or magnetic flux of the magnet 230 can be affected by the dart's environment (e.g., proximity to different materials and/or thicknesses of materials in the tubing string). In some embodiments, magnetometer 132 of dart 200 is configured to detect variations in strength (e.g., distortions) of the magnet's magnetic field and/or flux due to the influence of the features 70 in the tubing string as the dart 200 approaches, coincides with, and passes each feature 70. In other embodiments, in addition to or in lieu of an increased thickness, one or more features 70 may have magnetic properties, which may enhance the magnetic field and/or flux detectable by the magnetometer 132 when the dart 200 is near such features. By monitoring the change in magnetic field and/or flux of the magnet 230 as the dart 200 travels along passageway 30, the downhole location of the dart 200 may be determined in real-time.

In some embodiments, based on the signals generated by the magnetometer 132, the controller 123 detects and logs when the dart 200 is close to a feature 70 in the tubing string so that the controller 123 may determine the dart's downhole location at any given time. For example, a change in the signal of the magnetometer may indicate the presence of a feature 70 near the dart 200. In some embodiments, the magnetometer 132 is configured to measure the x-axis, y-axis, and z-axis components of the magnetic field and/or flux of the magnetic 230 as seen by the magnetometer 132, as the dart 200 travels in direction F. In the illustrated embodiment shown in FIG. 2C, the magnetometer 132 is positioned at the central longitudinal axis of the dart 200, with its z-axis parallel to direction F, and its x-axis and y-axis substantially orthogonal to the z-axis and to one another.

In this embodiment, the magnetic field M of the magnet 230 sensed by the magnetometer 132 can be determined by:

$$M=\sqrt{(x+p)^2+(y+q)^2+(z+r)^2} \quad \text{(Equation 2)}$$

where x is the x-axis component of the magnetic field detected by the magnetometer 132; p is an adjustment constant for the x-axis component; y is the y-axis component of the magnetic field detected by the magnetometer 132; q is an adjustment constant for the y-axis component; z is the z-axis component of the magnetic field detected by the magnetometer 132; and r is an adjustment constant for the z-axis component. Magnetic field M, as calculated using Equation 2, provides a measurement of a vector-specific magnetic field and/or flux as seen by magnetometer 132 in the direction of the magnet 230. In the illustrated embodiment, the vector from the magnetometer 132 to the magnet 230 is denoted by arrow Vm. In some embodiments, constants p, q, and r are determined based, at least in part, on one or more of: the magnetic strength of magnet 230, the dimensions of the dart 200; the configuration of the components inside the dart 200; and the permeability of the dart material. In some embodiments, constants p, q, and r are determined through calculation and/or experimentation.

By monitoring the magnetic field strength at the magnetometer 132 (i.e., in direction Vm), distortions of the magnet's magnetic field can be detected. In some embodiments, the controller 123 interprets the magnetic field and/or magnetic flux signal provided by the magnetometer 132 in the x, y, and z axes to detect a feature 70 in the dart's environment (i.e., near the magnet 230) as the dart 200 travels. In some embodiments, based on the signals from the magnetometer, the controller determines the value of magnetic field M using Equation 2 in real-time and checks for changes in the value of magnetic field M. In some embodiments, the magnetic field of the magnet 230 as detected by the magnetometer is stronger when the dart 200 coincides with a feature 70, because there is less absorption and/or deflection of the magnet's magnetic field while the dart 200 is in the feature than in the surrounding thinner segments of the tubing string 24. When the dart 200 exits the feature 70 and enters a thinner section of the tubing string, the magnetic field of the magnet 230 becomes weaker. In this embodiment, the controller 123 may check for an increase in magnetic field M to identify the dart's entrance into a feature 70 and a corresponding decrease in magnetic field M to confirm the dart's exit from the feature into a thinner section of the tubing string. In other embodiments, the controller 123 may detect a further increase in magnetic field M from the initial increase, which may indicate the dart's exit from the feature 70 into a thicker section of the tubing string.

Depending on its material and configuration, each feature 70 may cause an increase in the magnetic strength of the magnet 230, wherein the magnitude of the increased magnetic field is between a minimum value ("min M threshold") and a maximum value ("max M threshold"). Also, the length of the feature 70 may be selected such that, when dart 200 is travelling at a given speed in the tubing string, the increase in magnetic field strength caused by feature 70 is detectable for a time period between a minimum value ("min timespan") and a maximum value ("max timespan"). For example, for a feature 70, the min M threshold is 100 mT, the max M threshold is 200 mT, the min timespan is 0.1 second, the max timespan is 2 seconds. Collectively, the min M threshold, max M threshold, min timespan, and max timespan of each feature 70 constitute the parameters profile for that specific feature.

When the dart 200 is not close to a feature 70, the magnitude of the magnetic field M determined by the controller 123 based on the x-axis, y-axis, and z-axis signals from the magnetometer 132 can fluctuate but is below the min M threshold. When the dart 200 approaches a feature 70 in the tubing string, the magnitude of the detected magnetic field M rises above the min M threshold. In some embodiments, when the detected magnetic field M falls between the min M threshold and the max M threshold for a time period between the min timespan and max timespan, the controller 123 identifies the event as being within the parameters profile of the feature 70 and logs the event as the dart's passage through the feature 70. The controller 123 may use a timer to track the time elapsed while the magnetic field M stayed between the min and max M thresholds.

In some embodiments, all the features 70 in the tubing string 24 have the same parameters profile. In other embodiments, one or more features 70 have a distinct parameters profile such that when dart 200 passes through the one or more features 70, the change in magnetic field and/or magnetic flux detected by the magnetometer 132 is distinguishable from the change detected when the dart passes through other features in the tubing string. In some embodiments, at least one feature 70 in the tubing string has a first parameters profile and at least one feature 70 of the remaining features in the tubing string has a second parameters profile, wherein the first parameters profile is different from the second parameters profile.

By logging the dart's passage through one or more features 70 in the tubing string, the controller 123 can determine the downhole location of the dart 200 in real-time, either by cross-referencing the detected features 70 with the known locations thereof on the well map or by counting the number of features 70 (or the number of features 70 with specific parameters profiles) dart 200 has encountered. In some embodiments, the counter of the controller 123 maintains a count of the detected features 70. The controller 123 compares the current location of dart 200 with the target location, and upon determining that the dart has reached the target location, the controller 123 signals the actuation mechanism 124 to transform the dart into the activated position.

Figure 15:
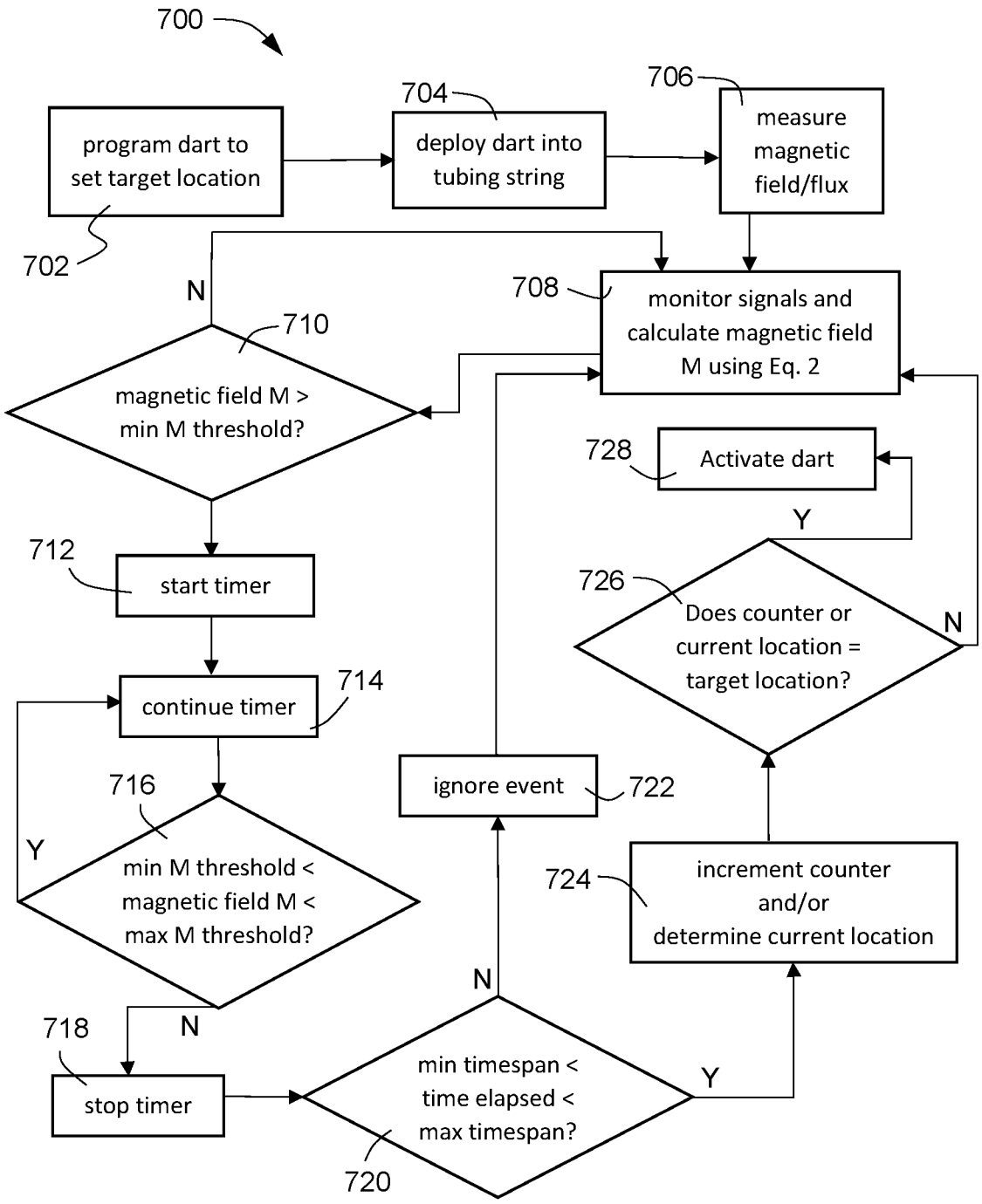
FIG. 15 is a flowchart of a method of determining a location of a dart in a wellbore, according to yet another embodiment.

FIG. 15 is a flowchart illustrating a sample process 700 for determining the downhole location of the dart 200 in multistage well 20*c*. At step 702, the dart 200 is programed with a desired target location. The dart 200 is then deployed in the tubing string (step 704). The magnetometer 132 of dart 200 continuously measures the magnetic field and/or flux in the x-axis, y-axis, and z-axis (step 706) and sends an x-axis signal, a y-axis signal, and a z-axis signal to the controller 123. Based on the x-axis signal, the y-axis signal, and the z-axis signal, and constants p, q, and r, the controller 123 determines magnetic field M using Equation 2 above (step 708). If the dart 200 is not close to a feature 70, the magnitude of magnetic field M may fluctuate but is generally below the min M threshold. As magnetic field M is continuously updated based on the signals received from the magnetometer 132, the controller 123 monitors the real-time value of magnetic field M to see whether the magnetic field M rises above the min M threshold (step 710).

If magnetic field M remains below min M threshold, the controller 123 does nothing and continues to interpret the x-axis, y-axis, and z-axis signals from the magnetometer 132 (step 708). If magnetic field M rises above the min M threshold, the controller 123 starts the timer (step 712). The controller 123 continues to run the timer (step 714) while monitoring the magnetic field M to check whether the real-time magnetic field M is between the min M threshold and the max M threshold (step 716). If the magnetic field M stays between the min M threshold and the max M threshold, the controller 123 continues to run the timer (step 714). If the magnetic field M falls outside the min and max M thresholds, the controller 123 stops the timer (step 718). The controller 123 then checks whether the time elapsed between the start time of the timer at step 712 and the end time of the timer at step 718 is between the min timespan and the max timespan (step 720). If the time elapsed is not between the min and max timespans, the controller 123 ignores the event (step 722) and continues to monitor the magnetic field M (step 708). If the time elapsed is between the min and max timespans, the controller 123 registers the event as the dart's passage of a feature 70 and increments the counter (step 724). At step 724, the controller 123 may also determine the current downhole location of the dart 200 based on the number of the counter and the known locations of the features 70 on the well map.

The controller 123 then proceeds to step 726, where the controller 123 checks whether the updated counter number or the determined current location of the dart 200 has reached the preprogrammed target location. If the controller determines that the dart has reached the target location, the controller 123 sends a signal to the actuation mechanism 124 to activate the dart 200 (step 728). If the controller determines that the dart 200 has not yet reached the target location, the controller 123 continues to monitor the magnetic field M (step 708).

Distance Calculation Based on Acceleration

In some embodiments, the real-time downhole location of the dart can be determined by analyzing the acceleration data of the dart. With reference to FIG. 2, according to one embodiment, dart 10,100,200 may comprise an accelerometer 134, which may be a three-axis accelerometer. Accelerometer 134 measures the dart's acceleration as the dart travels through passageway 30. Using the collected acceleration data, the distance travelled by the dart 10,100,200 can be calculated by double integration of the dart's acceleration at any given time. For example, in general, distance s at any given time t can be calculated by the following equation:

$$s(t)=s_0+\int^t v(t)dt=s_0+v_0t+\int^t\int^\tau a(\tau)d\tau dt \quad \text{(Equation 3)}$$

where v is the velocity of the dart, a is the acceleration of the dart, and τ is time.

Equation 3 can be used when the dart is traveling in a straight line and the acceleration a of the dart is measured along the straight travel path. However, the dart typically does not travel in a straight line through passageway 30 so the measured acceleration is affected by the Earth's gravity (1 g). If the effects of gravity are not taken into consideration, the distance s calculated by Equation 3 based on the detected acceleration may not be accurate. In some embodiments, the dart 10,100,200 comprises a gyroscope 136 to help compensate for the effects of gravity by measuring the rotation of the dart. Prior to deployment of dart 10,100,200, when the dart is stationary, the reading of the gyroscope 136 is taken and an initial gravity vector (e.g., 1 g) is determined from the gyroscope reading. After deployment, the rotation of the dart 10,100,200 is continuously measured by the gyroscope 136 as the dart travels downhole and the rotation measurement is adjusted using the initial gravity vector. Then, to take gravity into account, the real-time acceleration measured by the accelerometer 134 is corrected with the adjusted rotation measurement to provide a corrected acceleration. Instead of the detected acceleration, the corrected acceleration is used to calculate the distance traveled by the dart.

For example, to simplify calculations, the initial gravity vector is set as a constant that is used to adjust the rotation measurements taken by the gyroscope 136 while the dart is in motion. Further, while the dart 10,100,200 is moving in direction F, the z-axis component of acceleration (with the z-axis being parallel to direction F) as measured by the accelerometer 134 is compensated by the adjusted rotation measurements to generate the corrected acceleration $a_C$. Using the corrected acceleration $a_C$, the velocity v of the dart at a given time t can be calculated by:

$$v(t)=v_0+\int^t a_c(t)dt \quad \text{(Equation 4)}$$

where $a_C(t)$ is the corrected acceleration at time t and $v_o$ is the initial velocity of the dart. In some embodiments, $v_o$ is zero. Based on the velocity v calculated using Equation 4, the distance s traveled by the dart at time t can then be calculated by:

$$s(t)=s_0+\int^t v(\tau)d\tau \quad \text{(Equation 5)}$$

Further, the error in the distance s calculated from the corrected acceleration $a_C$ using Equations 4 and 5 may grow as the magnitude of the acceleration increases. Therefore, in some embodiments, changes in magnetic field and/or flux as detected by magnetometer 132, as described above, can be used for corroboration purposes for correcting any errors in the distance s calculated using data from the accelerometer 134 and the gyroscope 136 to arrive at a more accurate determination of the dart's real-time downhole location.

In some embodiments, the dart's real-time downhole location as determined by the controller 123 based, at least in part, on the acceleration and rotation data is compared to the target location. When the controller 123 determines that the dart 10,100,200 has arrived at the target location, the controller 123 sends a signal to the actuation mechanism 124 to effect activation of the dart to, for example, perform a downhole operation.

Dart Actuation Mechanism

Figure 5A:
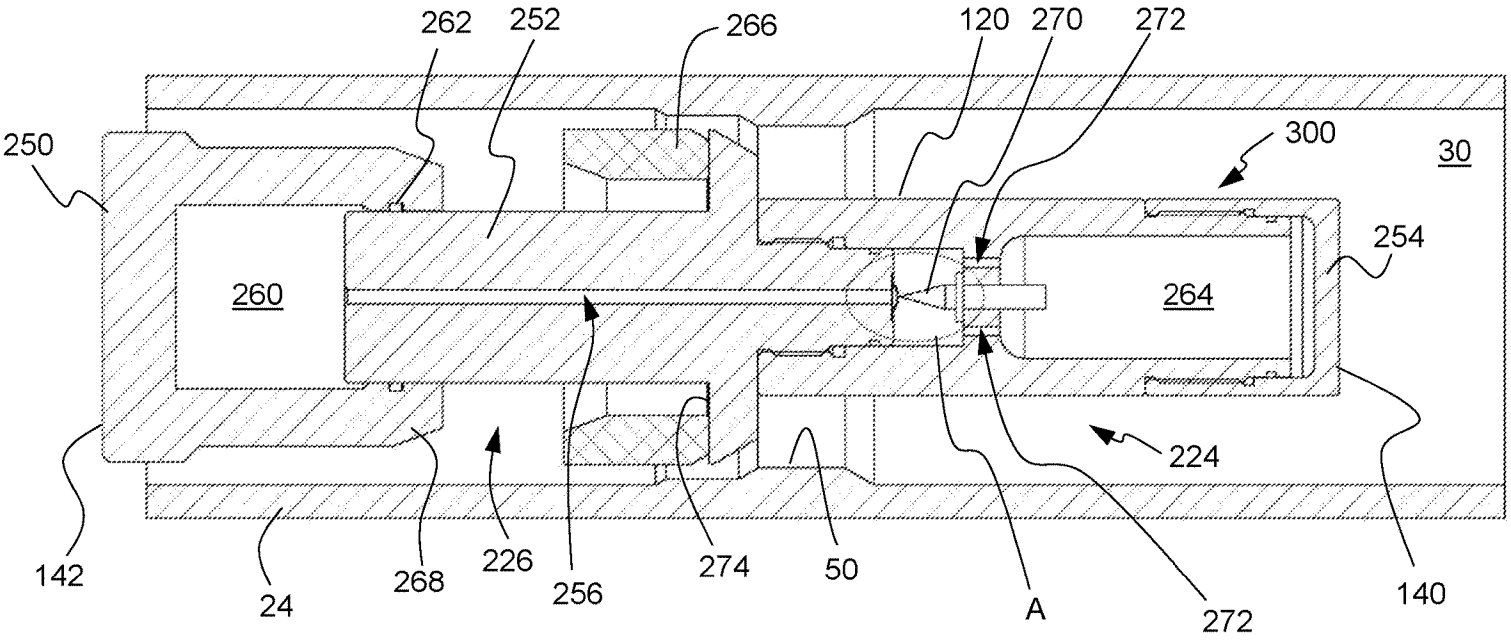
FIG. 5A is a schematic axial cross-sectional view of a dart, shown in an inactivated position, according to one embodiment of the present disclosure.

FIG. 5A shows one embodiment of a dart 300 having an actuation mechanism configured to transform the dart into the activated position, when the dart's controller determines that the dart has reached the target location. The dart 300 is shown in the inactivated position in FIGS. 5A and 5B. For simplicity, some components such as the control module and magnets of the dart 300 are not shown in FIG. 5A. Dart 300 comprises an actuation mechanism 224 having a first housing 250 defining therein a hydrostatic chamber 260, a piston 252, and a second housing 254 defining therein an atmospheric chamber 264. The hydrostatic chamber 260 contains an incompressible fluid, while the atmospheric chamber 264 contains a compressible fluid (e.g., air) that is at about atmospheric pressure. In other embodiments, the atmospheric chamber is a vacuum.

Figure 5B:
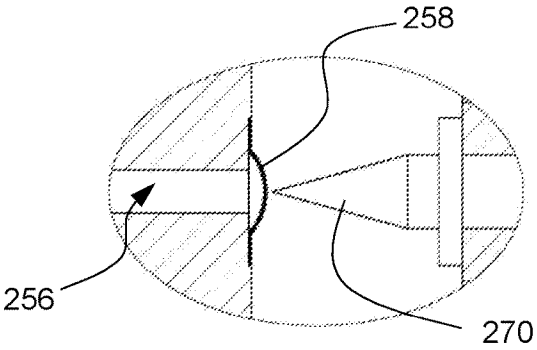
FIG. 5B is a magnified view of area "A" of FIG. 5A, showing an intact burst disk.

One end of the piston 252 extends axially into the hydrostatic chamber 260 and the interface between the outer surface of the piston 252 and the inner surface of the chamber 260 is fluidly sealed, for example via an o-ring 262. The piston 252 is configured to be axially slidably movable, in a telescoping manner, relative to the first housing 250; however, such axial movement of the piston 252 is restricted when the hydrostatic chamber 260 is filled with incompressible fluid. The piston 252 has an inner flow path 256 and, as more clearly shown in FIG. 5B, one end of the flow path 256 is fluidly sealed by a valve 258 when the dart 300 is in the inactivated position. The valve 258 controls the communication of fluid between the chambers 260, 264. The valve 258 in the illustrated embodiment is a burst disk. The burst disk 258, when intact (as shown in FIG. 5B), blocks fluid communication between the chambers 260,264 by blocking fluid flow through the flow path 256. In the sample embodiment shown in FIG. 5A, the actuation mechanism 224 comprises a piercing member 270 operable to rupture the burst disk 258. When the dart 300 is not activated, as shown in FIG. 5B, the piercing member 270 is adjacent to but not in contact with the burst disk 258.

In the illustrated embodiment in FIG. 5A, the dart 300 comprises an engagement mechanism 266 positioned at an engagement section 226 of the dart. The engagement mechanism 266 is actuable from an inactivated position to an activated position. The actuation mechanism 224 is configured to selectively actuate the engagement mechanism 266 to transition the mechanism 266 to the activated position, thereby placing the dart in the activated position. In the illustrated embodiment, engagement mechanism 266 comprises expandable slips 266 supported on the outer surface of the piston 252. The first housing 250 has a frustoconically-shaped end 268 adjacent the slips 266 for matingly engaging same. Frustoconically-shaped end 268 is also referred to herein as cone 268. When the slips 266 in the inactivated (or "initial") position, as shown in FIG. 5A, the slips 266 are retracted and are not engaged with the cone 268. When activated, slips 266 are expanded radially outwardly by engaging the cone 268, as described in more detail below.

Upon receiving an activation signal from the controller of the dart, the actuation mechanism 224 operates to actuate the engagement mechanism 266 by opening valve 258. In some embodiments, the actuation mechanism 224 comprises an exploding foil initiator (EFI) that is activated upon receipt of the activation signal, and a propellant that is initiated by the EFI to drive the piercing member 270 into the burst disk 258 to rupture same. As a skilled person in the art can appreciate, other ways of driving the piercing member 270 to rupture burst disk 258 are possible.

Figure 6A:
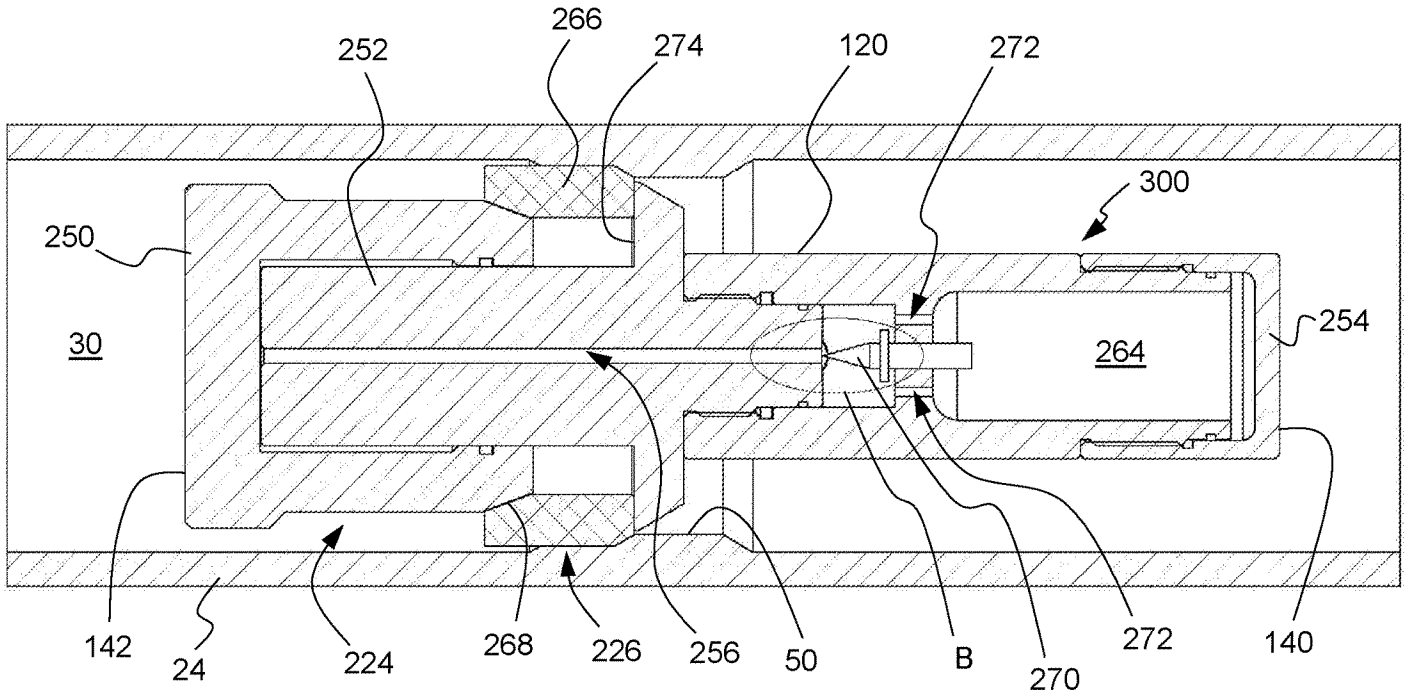
FIG. 6A is a schematic axial cross-sectional view of the dart of FIG. 5A, shown in an activated position, according to one embodiment of the present disclosure.
Figure 6B:
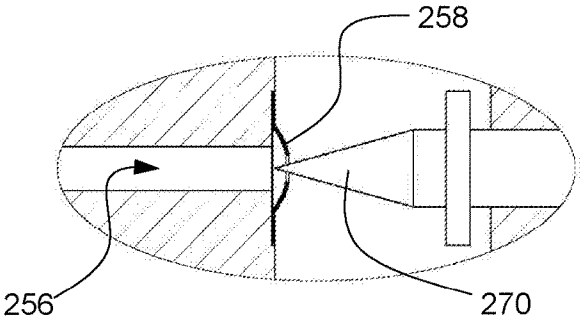
FIG. 6B is a magnified view of area "B" of FIG. 6A, showing a ruptured burst disk.

FIG. 6A shows the dart 300 in its activated position, according to one embodiment. As shown in FIGS. 6A and 6B, the burst disk 258 is ruptured by the piercing member 270. Once the burst disk 258 is ruptured, the flow path 256 is unblocked. The unblocking of flow path 256 establishes fluid communication between the hydrostatic chamber 260 and the atmospheric chamber 264, whereby incompressible fluid from chamber 260 can flow to chamber 264 via flow path 256 and ports 272 to equalize the pressures in the chambers 260,264. The equalization of pressure causes the piston 252 to further extend axially into the hydrostatic chamber 260, which in turn shifts the first housing 250, along with cone 268, axially towards the slips 266, causing the cone to slide (further) under the slips, thereby forcing the slips to expand radially outwardly to place the engagement mechanism 266 into the activated (or "expanded") position. In some embodiments, once the engagement mechanism 266 is activated, the dart 300 is placed in the activated position.

In some embodiments, the engagement mechanism 266 is configured such that its effective outer diameter in the inactivated (or initial) position is less than the inner diameter of the tubing string and the features in the tubing string. In the activated (or expanded) position, the effective outer diameter of the engagement mechanism 266 is greater than the inner diameter of a feature (e.g., a constriction 50) in tubing string 24. When activated, the engagement mechanism 266 can engage the feature so that the activated dart 300 can be caught by the feature. Where the feature is a downhole tool and the dart 300 is caught by the tool, the dart may act as a plug and the tool may be actuated by the dart by the application of fluid pressure in the tubing string from surface E, to cause pressure uphole from the dart 300 to increase sufficiently to move a component (e.g., shift a sleeve) of the tool.

While in some embodiments the activated dart 300 is configured to operate as a plug in the tubing string 24, which may be useful for wellbore treatment, the dart's continued presence downhole may adversely affect backflow of fluids, such as production fluids, through tubing string 24. Thus, in some embodiments, dart 300 may be removeable with backflow back toward surface E. In alternative embodiments, the dart 300 may include a valve openable in response to backflow, such as a one-way valve or a bypass port openable sometime after the dart's plug function is complete. In other embodiments, at least a portion of the dart 300 is formed of a material dissolvable in downhole conditions. For example, a portion of the dart (e.g., the body 120) may be formed of a material dissolvable in hydrocarbons such that the portion dissolves when exposed to back flow of production fluids. In another example, the dissolvable portion of the dart may break down at above a certain temperature or after prolonged contact with water, etc. In this embodiment, for example, after some residence time during hydrocarbon production, a major portion of the dart is dissolved leaving only small components such as the control module, magnets, etc. that can be produced to surface with the backflowing produced fluids. Alternatively, the activated dart 300 can be drilled out.

FIGS. 7 to 10 show an alternative engagement mechanism 366. Instead of slips, engagement mechanism 366 comprises a seal 310, such as an elastomeric seal, a first support ring 330 and a second support ring 350, all supported on the outer surface of cone 268 or alternatively the outer surface of the piston 252 (shown in FIG. 5). For simplicity, in FIGS. 7 to 10, engagement mechanism 366 is shown without the other components of dart 300. The engagement mechanism 366 has an initial position, shown in FIG. 7 (with cone 268) and FIG. 8 (without cone 268), and an expanded position, shown in FIG. 9 (with cone 268) and FIG. 10 (without cone 268). In some embodiments, when the dart 300 is in the inactivated position, the engagement mechanism 366 is in the initial position, and when the dart is in the activated position, engagement mechanism 366 is in the expanded position.

In the illustrated embodiment, the seal 310 is an annular seal having an outer surface 312 and an inner surface 314, the latter defining a central opening for receiving a portion of the cone 268 therethrough. In some embodiments, the inner surface of the seal 310 is frustoconically shaped for matingly abutting against the outer surface of cone 268. The seal 310 is expandable radially to allow the seal 310 to be slidably movable from a first axial location of the cone 268 to a second axial location of the cone 268, wherein the outer diameter of the second axial location is greater than that of the first axial location. In some embodiments, the seal 310 is formed of an elastic material that is expandable to accommodate the greater outer diameter of the second axial location, while maintaining abutting engagement with the outer surface of cone 268 (as shown for example in FIG. 9A). In the illustrated embodiment, a first support ring 330 is disposed in between the seal 310 and a second support ring 350.

Figure 10C:
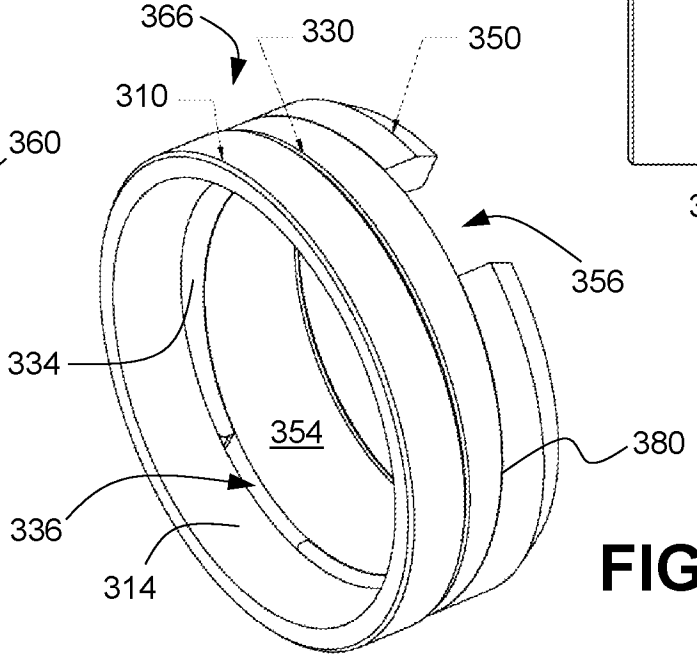
Figure 12A:
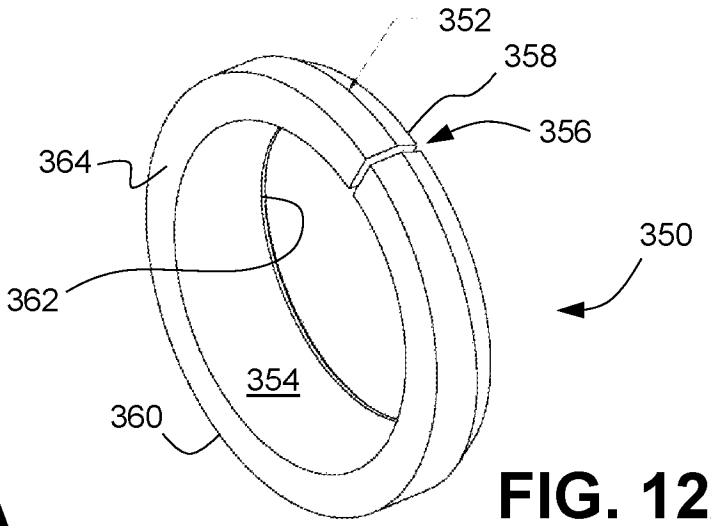
FIG. 12A is a perspective view of a second support ring of the engagement mechanism of FIG. 8, according to one embodiment.
Figure 12B:
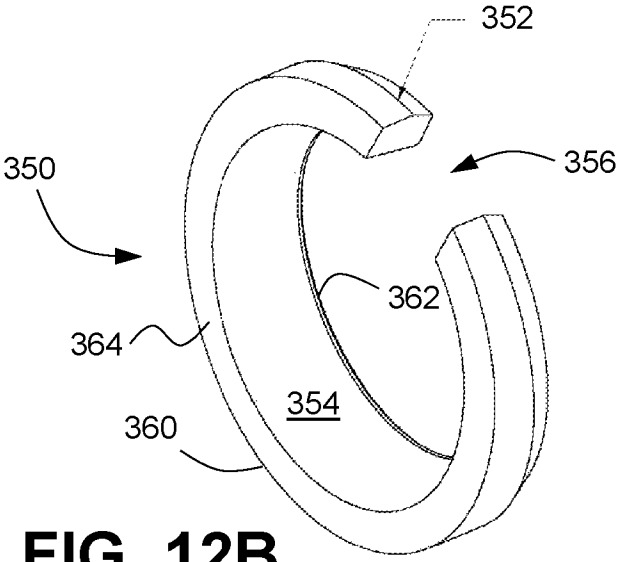
FIG. 12B is a perspective view of the second support ring of the engagement mechanism of FIG. 10, according to one embodiment.
Figure 11A:
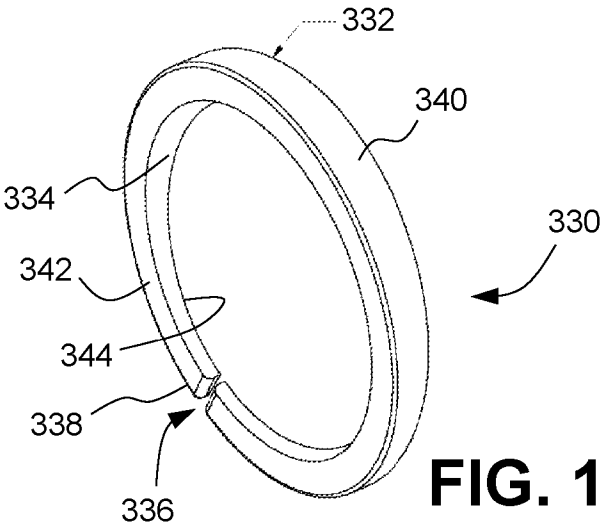
FIG. 11A is a perspective view of a first support ring of the engagement mechanism of FIG. 8, according to one embodiment.
Figure 11B:
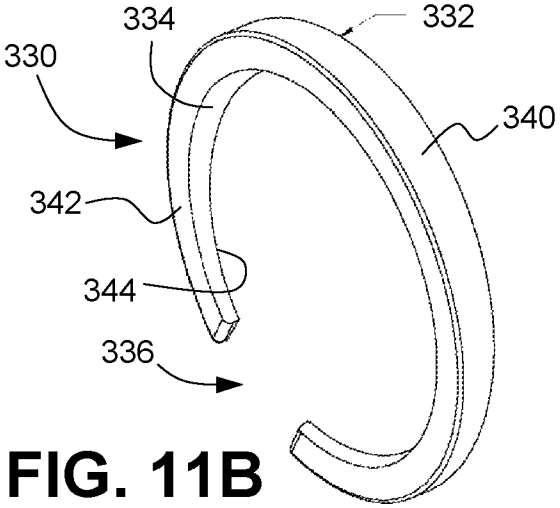
FIG. 11B is a perspective view of the first support ring of the engagement mechanism of FIG. 10, according to one embodiment.

With further reference to FIGS. 11 and 12, each support ring 330,350 has a respective outer surface 332,352 and a respective inner surface 334,354, the latter defining a central opening for receiving a portion of the cone 268 therethrough. In some embodiments, the inner surface 334,354 of each ring 330,350 may be frustoconically shaped for matingly abutting against the outer surface of cone 268. The first and second support rings 330,350 are expandable radially to allow the rings to be slidably movable from a first axial location to a second axial location of the cone 268, wherein the outer diameter of the second axial location is greater than that of the first axial location. To allow for radial expansion to accommodate the greater outer diameter of the second axial location, the first and second support rings 330,350 each have a respective gap 336,356 that can be widened when a radially outward force is exerted on the inner surface 334,354, respectively, thereby increasing the size of the central opening and the effective outer diameter of each of the rings 330,350. When the gaps 336,356 are widened (as shown for example in FIGS. 11B and 12B), the inner surfaces 334,354 may remain in abutting engagement with the outer surface of cone 268 (as shown for example in FIG. 9A). In some embodiments, the first and second support rings 330,350 are positioned on the cone 268 such that the gaps 336,356 are azimuthally offset from one another. In one embodiment, as shown for example in FIGS. 8C and 10C, the gaps 336,356 are azimuthally spaced apart by about 180°.

In some embodiments, the axial length of the first and/or second support rings 330,350 is substantially uniform around the circumference of the ring. In some embodiments, the axial length of the first support ring 330 may be less than, about the same as, or greater than the axial length of the second support ring 350.

Figure 8B:
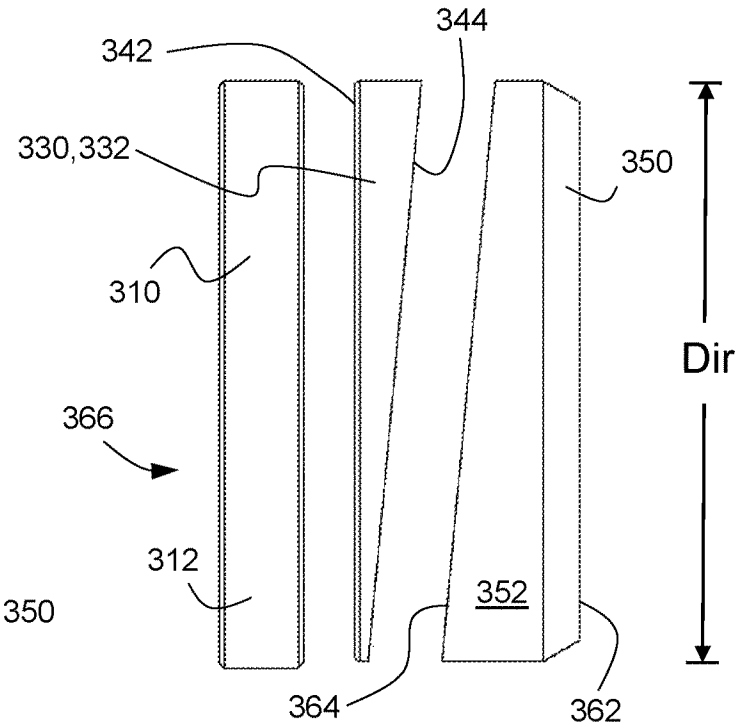
FIGS. 8A, 8B, and 8C are a side view, an exploded side view, and a perspective view, respectively, of the engagement mechanism of FIG. 7, shown without the cone.
Figure 8A:
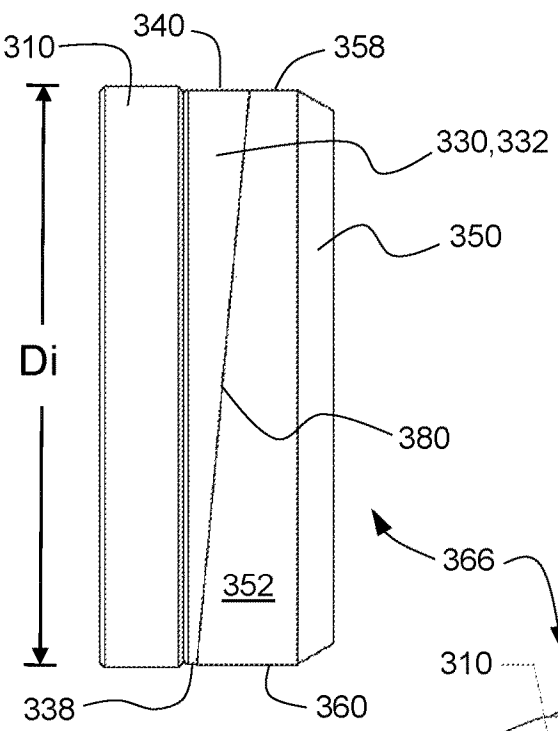
Figure 8C:
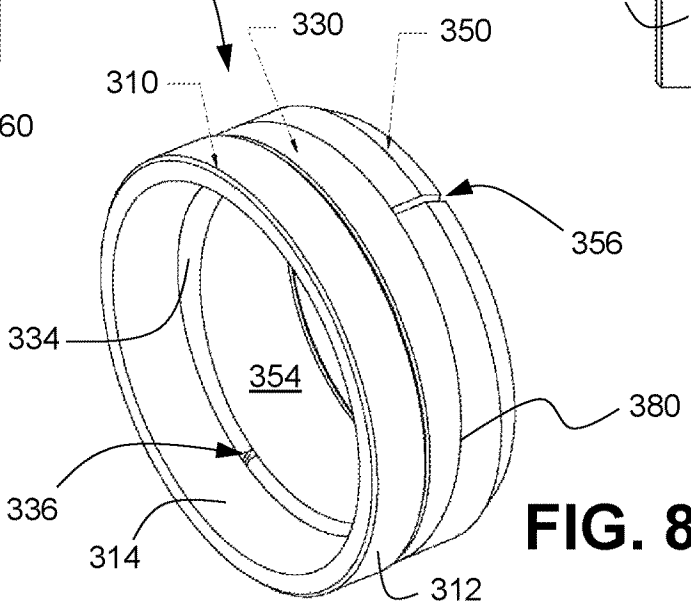
Figure 10B:
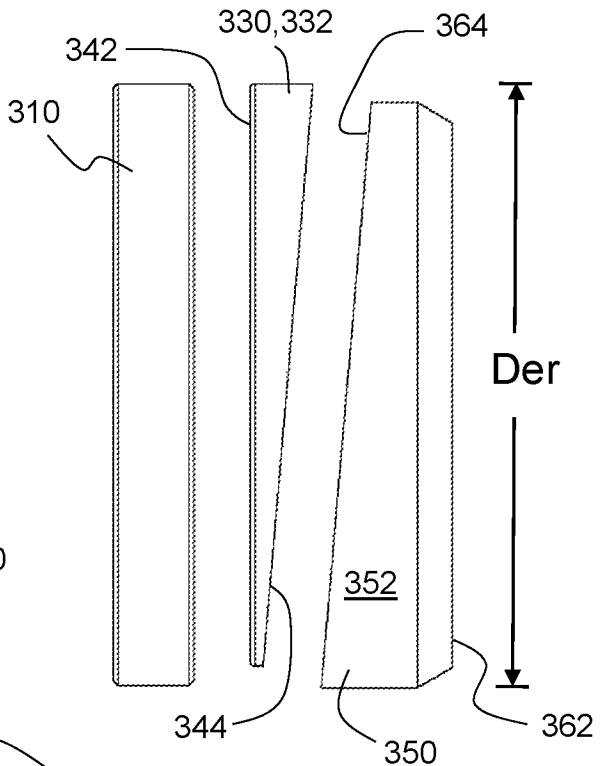
FIGS. 10A, 10B, and 10C are a side view, an exploded side view, and a perspective view, respectively, of the engagement mechanism of FIG. 9, shown without the cone.

In the illustrated embodiment, the axial length of the first support ring 330 varies around its circumference. In the illustrated embodiment, as best shown in FIGS. 8, 10, and 11, the first support ring 330 has a short side 338 and a long side 340, where the long side 340 has a longer axial length than the short side 338. The first support ring 330 has a first face 342 at a first end, extending between the short side 338 and the long side 340; and an elliptical face 344 at a second end, extending between the short side 338 and the long side 340. In some embodiments, the axial length of the first ring 330 around its circumference gradually increases from the short side 338 to the long side 340, and correspondingly gradually decreases from the long side 340 to the short side 338, to define the first face 342 on one end and the elliptical face 344 on the other end. In a sample embodiment, the plane of elliptical face 344 is inclined at an angle ranging from about 1° to about 30° relative to the plane of first face 342. In some embodiments, the elliptical face 344 is inclined at about 5° relative to the plane of the first face 342. In some embodiments, the gap 336 of the first ring 330 is positioned at or near the short side 338, to minimize the axial length of gap 336. While first face 342 is shown in the illustrated embodiment to be substantially circular, first face 342 may not be circular in shape in other embodiments.

In the illustrated embodiment, the axial length of the second support ring 350 varies around its circumference. In the illustrated embodiment, as best shown in FIGS. 8, 10, and 12, the second support ring 350 has a short side 358 and a long side 360, where the long side 360 has a longer axial length than the short side 358. The second support ring 350 has a second face 362 at a first end, extending between the short side 358 and the long side 360; and an elliptical face 364 at a second end, extending between the short side 358 and the long side 360. In some embodiments, the axial length of the second ring 350 around its circumference gradually increases from the short side 358 to the long side 360, and correspondingly gradually decreases from the long side 360 to the short side 358, to define the second face 362 on one end and the elliptical face 364 on the other end. In a sample embodiment, the plane of elliptical face 364 is inclined at an angle ranging from about 1° to about 30° relative to the plane of second face 362. In some embodiments, the elliptical face 364 is inclined at about 5° relative to the second face 362. In some embodiments, the gap 356 of the second ring 350 is positioned at or near the short side 358, to minimize the axial length of gap 356. While second face 362 is shown in the illustrated embodiment to be substantially circular, second face 362 may not be circular in shape in other embodiments.

In some embodiments, the axial length of the long side 360 of the second ring 350 is greater than, about the same as, or less than that of the long side 340 of the first ring 330. In some embodiments, the axial length of the short side 358 of the second ring 350 is greater than, about the same as, or less than that of the short side 338 of the first ring 330. In some embodiments, the axial length of the short side 358 of the second ring 350 may be less than, about the same as, or greater than that of the long side 340 of the first ring 330. In sample embodiments, the axial length of the short side 338 of first support ring 330 is: about 10% to about 30% of the axial length of the long side 340; about 18% to about 38% of the axial length of the short side 358 of second support ring 350; and about 3% to about 23% of the axial length of the long side 360 of second support ring 350. In sample embodiments, the axial length of the short side 338 of first support ring 330 is about 6% to about 26% of the axial length of the seal 310. In some embodiments, the axial length of the long side 360 of the second support ring 350 is about 109% to about 129% of the axial length of the seal 310. In other embodiments, the axial length of the short side 358 of second support ring 350 is: about 10% to about 30% of the axial length of the long side 360; about 18% to about 38% of the axial length of the short side 338 of first support ring 330; and about 3% to about 23% of the axial length of the long side 340 of first support ring 330. As a person skilled in the art can appreciate, other configurations are possible.

With reference to FIGS. 7 to 10, in some embodiments, the elliptical faces 344,364 are configured for mating abutment with one another to define an elliptical interface 380 between the first and second rings, when the first and second rings are engaged with each other. In some embodiments, the first and second rings 330,350 are arranged in engagement mechanism 366 so that the short side 338 of the first ring 330 is positioned adjacent to the long side 360 of the second ring 350; and the short side 358 of the second ring 350 is positioned adjacent to the long side 340 of the first ring 330. In some embodiments, as illustrated in FIGS. 8C and 10C, the gaps 336,356 are positioned at the short sides 338,358, of the first and second support rings 330,350, respectively, such that the gaps 336,356 are azimuthally aligned with the long sides 360,340, respectively, and are offset azimuthally by about 180°.

Figure 7B:
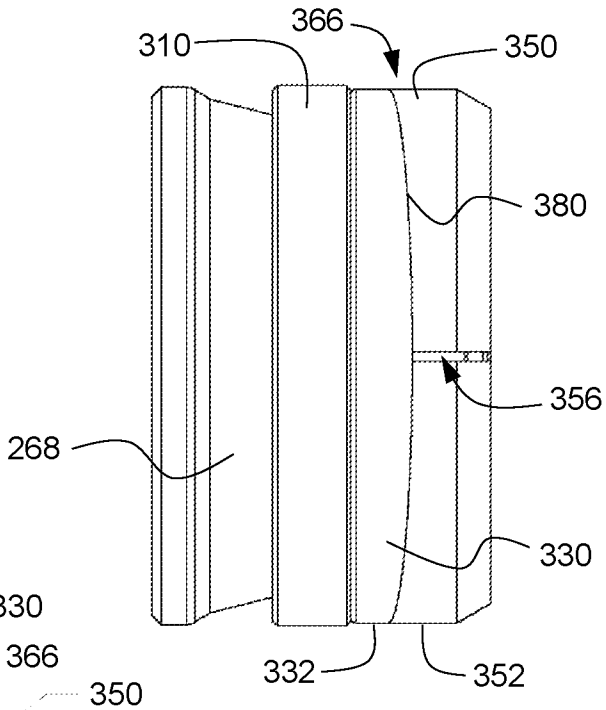
FIGS. 7A, 7B, and 7C are a side cross-sectional view, a side plan view, and a perspective view, respectively, of an engagement mechanism and a cone of a dart, shown in an inactivated position, according to one embodiment of the present disclosure.
Figure 7C:
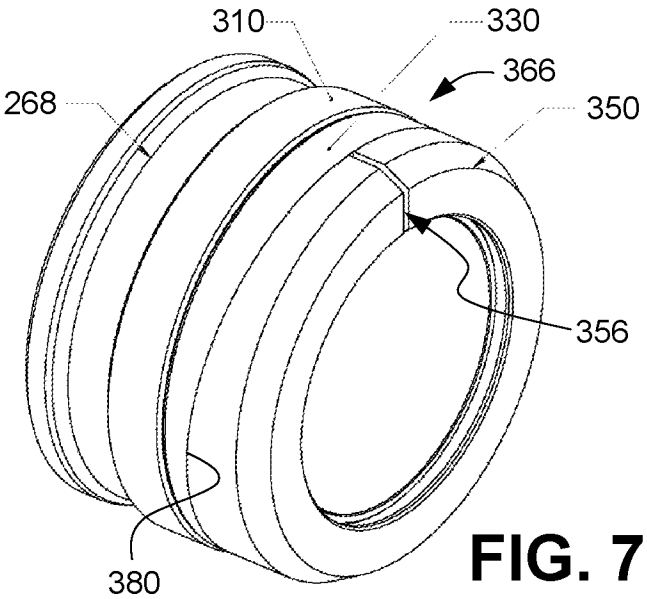
Figure 7A:
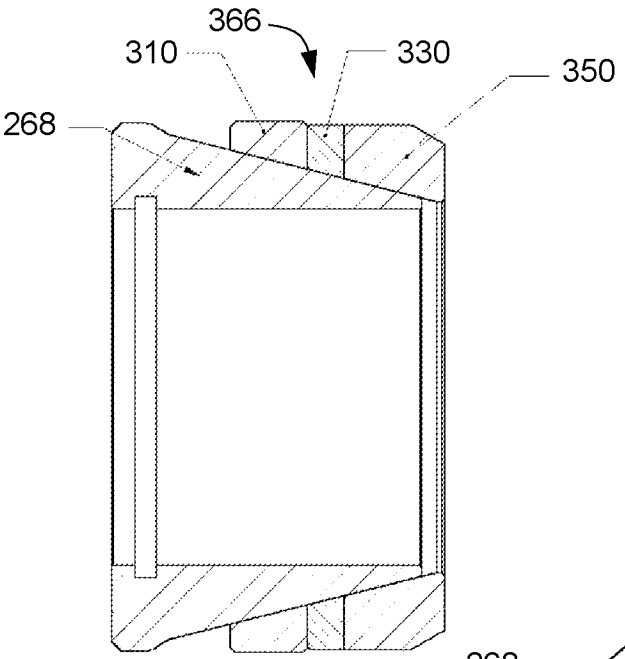

When the dart 300 is in the inactivated position, the engagement mechanism is in the initial position, as shown in FIGS. 7 and 8, wherein the seal 310, the first support ring 330, and the second support ring 350 are supported on either the piston 252 (FIG. 5A) or a first axial location of the cone 268. In some embodiments, the second ring 350 is positioned adjacent to (and may abut against) a shoulder 274 of the piston 252 (FIG. 5A) such that the second face 362 faces the shoulder 274. The shoulder 274 limits the axial movement of the engagement mechanism 366 in the direction towards the leading end 140. In some embodiments, at least a portion of the inner surface 314,334,354 of the seal 310, the first ring 330, and/or the second ring 350, respectively, may abut against the outer surface of cone 268. In some embodiments, the seal 310 and the rings 330,350 are concentrically positioned on the cone and relative to one another. In the initial position, the effective outer diameter of the engagement mechanism 366 is smaller than the inner diameter of the features (i.e., constrictions) in the tubing string, thereby allowing the dart 300 to travel down the tubing string without interference. In some embodiments, in the initial position, the outer surface 312 of the seal 310 has an outer diameter Di and the outer surfaces 332,352 of the first and second rings 330,350 each have an effective outer diameter Dir. The outer diameter Dir of the first and second rings 330,350 may be the same in some embodiments and may be different in other embodiments. In some embodiments, outer diameter Di of the seal 310 is slightly greater than outer diameter Dir of the first and second rings 330,350. In some embodiments, the outer diameters Di and Dir are smaller than the inner diameter of the features in the tubing string. In the inactivated position, the gaps 336,356 each have an initial width.

To transition the engagement mechanism 366 to the expanded position, the cone 268 is pushed axially towards the engagement mechanism, for example, by operation of the actuation mechanism 224 as described above with respect to dart 300. When the second ring 350 abuts against the shoulder 274 of the piston 252 (FIG. 5A), the axial movement of the cone 268 relative to the engagement mechanism 366 slidably shifts the engagement mechanism 366 from the first axial location of the cone to a second axial location of the cone, wherein the second axial location has a greater outer diameter than that of the first axial location. When the engagement mechanism 366 engages a larger outer diameter of the cone 268, the increase in outer diameter of the cone from the first axial location to the second axial location exerts a force on the inner surfaces 314,334, 354 of the seal 310, the first ring 330, and the second ring 350, respectively. Due to the frustoconically shaped outer surface of the cone 268 and the matingly shaped inner surfaces 314,334,354, the force exerted on the seal 310 and the rings 330,350 may be a combination of a radially outward force and an axial compression force. In some embodiments, the exerted force causes the seal 310 to expand radially and the gaps 336,356 of the first and second rings 330,350 to widen to accommodate the larger diameter portion of the cone, thereby placing the engagement mechanism 366 into the expanded position.

Figure 9B:
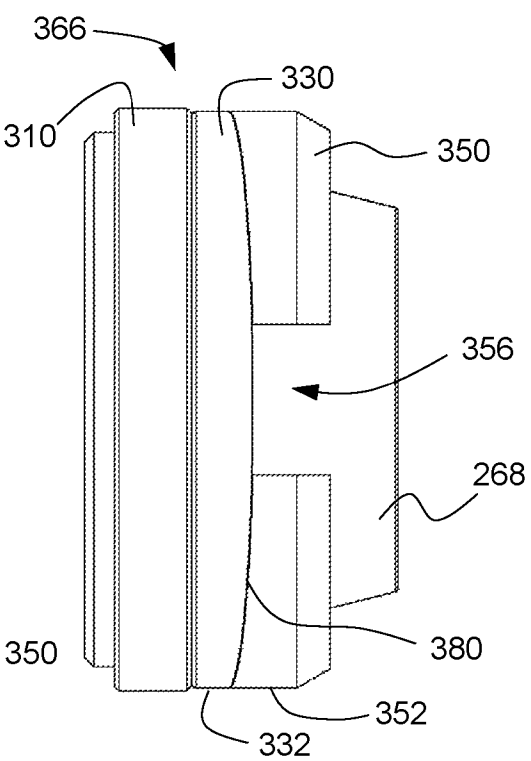
FIGS. 9A, 9B, and 9C are a side cross-sectional view, a side plan view, and a perspective view, respectively, of the engagement mechanism and the cone of FIG. 7, shown in an activated position, according to one embodiment of the present disclosure.
Figure 9C:
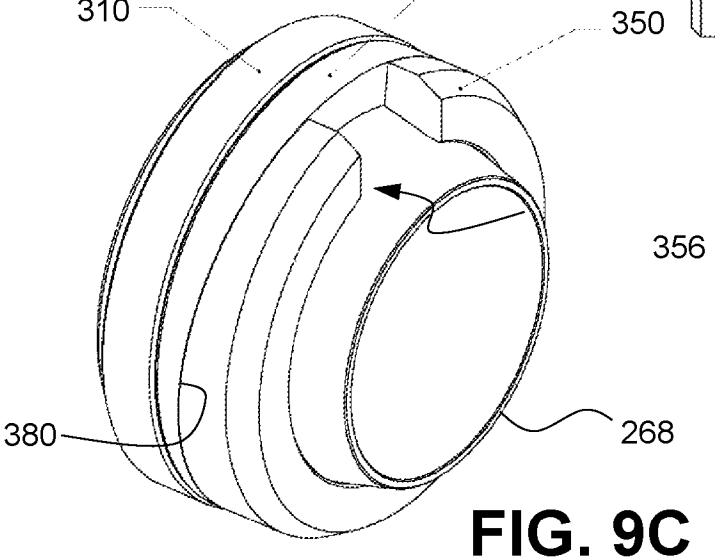
Figure 9A:
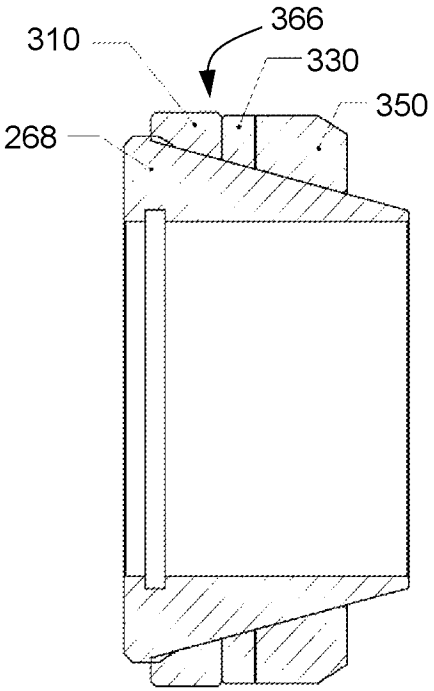

In the expanded position, as shown in FIGS. 9 and 10, the seal 310, the first support ring 330, and the second support ring 350 are supported on the second (larger outer diameter) axial location of the cone 268. In some embodiments, at least a portion of the inner surface 314,334,354 of the seal 310, the first ring 330, and/or the second ring 350, respectively, may abut against the outer surface of cone 268. In the expanded position, the effective outer diameter of the engagement mechanism 366 is greater than the inner diameter of the features (i.e., constrictions) in the tubing string, thereby allowing the dart 300 to be caught by the next feature in the dart's path.

In some embodiments, in the expanded position, the outer surface 312 of the seal 310 has an outer diameter De which is greater than the outer diameter Di at the initial position. In the expanded position, the gaps 336,356 of rings 330,350 are widened, as best shown in FIGS. 10C, 11B, and 12B, such that the width of each of the gaps 336,356 is greater than their respective initial width (shown in FIGS. 8C, 11A, and 12A). The widening of gaps 336,356 may increase the effective outer diameters of the first and second rings 330, 350. The effective outer diameter of the first and second rings 330,350 in the expanded is denoted by "Der". The outer diameter Der of the rings 330,350 is greater than the outer diameter Dir at the initial position. The outer diameter Der of the first and second rings 330,350 may be the same in some embodiments and may be different in other embodiments. In some embodiments, outer diameter De of the seal 310 is slightly greater than outer diameter Der of the first and second rings 330,350. In the expanded position, one or both of the outer diameters De,Der are greater than the inner diameter of at least one feature in the tubing string.

Figure 10A:
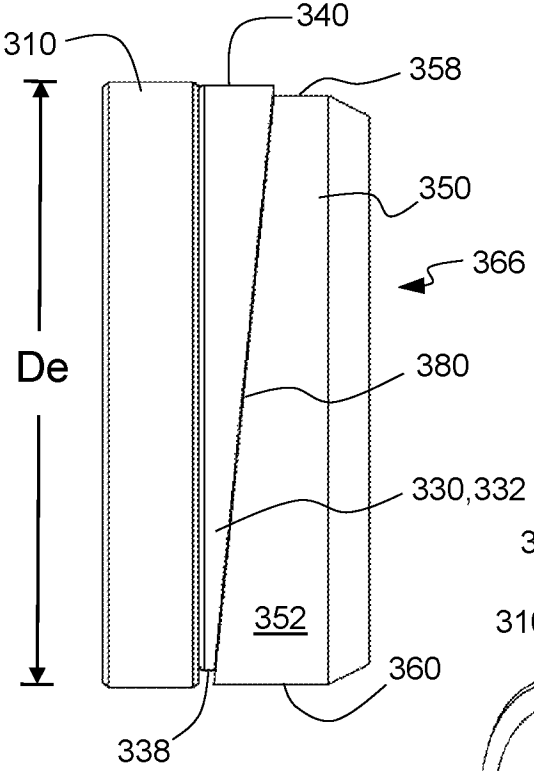

In some embodiments, as best shown in FIG. 10A, the shift to a larger outer diameter portion of the cone 268 forces the seal 310 to abut against the first face 342 of the first ring 330 and/or the elliptical face 344 of the first ring 330 to abut against the elliptical face 364 of the second ring 350. The engagement of the elliptical faces 344,364 forms the elliptical interface 380 between the rings 330,350. When under axial compression, the elliptical interface 380 may cause the rings 330,350 to offset radially relative to one another, which may help maximize the effective outer diameter Der across the rings, between the long side 340 to the long side 360. The radial offsetting of the rings 330,350 may cause the rings to become eccentrically positioned relative to one another. As best shown in FIG. 10C, the rings 330,350, together, provide structural support for the seal 310, especially in the expanded position. In some embodiments, a majority portion of the seal 310 around its circumference is supported by the combined axial length of material of the first and second rings 330,350. The portions of the seal 310 that are not supported by the combination of the first and second rings are the areas of the seal that are azimuthally aligned with the gaps 336,356. The area of the seal 310 that is aligned with gap 356 of the second ring 350 is supported by the first ring 330 (e.g., the long side 340 of the first ring 330).

As best shown in FIG. 10, where the gaps 336,356 are positioned at or near the short sides 338,358 of the rings 330,350, respectively, and where the rings 330,350 are arranged such that each short side 338,358 is positioned adjacent to the long side 360,340 of the other ring, the longest axial section of each ring 330,350 provides structural support to the other ring at the widened gap 356,336. When the rings are so arranged, the areas of the seal 310 that are azimuthally aligned with the gaps 336,356 are also aligned with the longest axial sections (i.e., long sides 360,340, respectively) of the rings 330,350.

In some embodiments, where the length of short side 338 is less than that of short side 358, the widened gap 336 is shorter axially than the widened gap 356 even if the circumferential width of the gaps 336,356 may be about the same. As a result, the gap 336 has less volume than the gap 356. By configuring and arranging the rings 330,350 as described above and placing the seal 310 against the first ring 330, the amount of space into which the expanded seal 310 may extrude can be minimized without compromising the overall support of the seal by the rings 330,350. Minimizing the amount of extrusion of the expanded seal 310 may help reduce structural damage to the seal that may affect its sealing function.

In some embodiments, the first and/or second support rings 330,350 may be made of one or more of: metal, such as aluminum; and alloy, such as brass, steel, magnesium alloy, etc. In some embodiments, the first and/or second support rings 330,350 are made, at least in part, of a dissolvable material such as dissolvable magnesium alloy.

While engagement mechanisms 266,366 are described above with respect to an untethered dart, it can be appreciated that the engagement mechanisms disclosed herein can also be used in other downhole tools, including a tethered device that is conveyed into the tubing string by wireline, coiled tubing, or other methods known to those in the art.

In other embodiments, the engagement mechanism of the dart may be retractable dogs, a resilient bladder, a packer, etc. For example, instead of slips or an annular seal, the dart may include retractable dogs that protrude radially outwardly from the body 120 but are collapsible when the dart is inactivated in order to allow the dart to squeeze through non-target constrictions. When the dart is activated, a back support (for example, a portion of the first housing 250 in FIG. 5A) is moved against the dogs such that the dogs are no longer able to collapse. The effective outer diameter of the dogs, when not collapsed, is greater than the inner diameter of the constrictions. As a result, when the dart is inactivated, the dogs can collapse to allow the dart to pass through a constriction and can re-extend radially outwardly after passing through the constriction. When the dart is activated, the dogs cannot collapse, and the dart can thus engage the constriction of the target tool as the dart cannot pass therethrough. In this manner, fluid pressure can be applied against the dart to actuate the target tool as described above. In some embodiments, protrusions 128 of the dart (see FIG. 2B) serve as the retractable dogs. In other embodiments, the retractable dogs are separate from protrusions 128.

In another sample embodiment, the deployment element may be a resilient bladder having an outer diameter that is greater than the inner diameter of the constrictions. In embodiments, the outer diameter of the bladder is greater than the remaining portion of the body 120 of the dart so only the bladder has to squeeze through each constriction as the dart passes therethrough. The bladder can resiliently collapse inwardly to allow the dart to pass through the constriction and can regain its shape after passing therethrough. The bladder can be formed of various resilient materials know to those skilled in the art that are usable in downhole conditions. When the dart is activated, the bladder can no longer collapse. This may be achieved, for example, by the bladder defining the atmospheric chamber of the dart and the bladder becomes un-collapsible as a result of incompressible fluid entering the bladder from the hydrostatic chamber after the actuation mechanism is activated. When the bladder is deployed (i.e. becomes un-collapsible) and the dart can then engage a constriction of the target tool downhole therefrom as the deployed bladder can no longer squeeze through the constriction. In this manner, fluid pressure can be applied against the dart to actuate the target tool as described above. In some embodiments, the bladder acts as protrusions 128 of the dart (see FIG. 2) and the rare-earth magnets 130 are embedded in the bladder. In other embodiments, the bladder is separate from protrusions 128.

It is noted that the foregoing devices, systems, and methods do not require any electronics or power supplies in the tubing string or in the wellbore to operate. As such, the tubing string may be run into the wellbore ahead of the deployment of the devices, as there is no concern of battery charge, component damage, etc. Also, the tubing string itself requires little special preparation ahead of installation, as all features (i.e., tools, sleeves, etc.) therein can be substantially the same, can be interchangeable, and/or can be installed in the tubing string in no particular order. Further, the number of features, although likely known ahead of run in, can be readily determined even after the tubing string is installed downhole.

According to a broad aspect of the present disclosure, there is provided a method comprising: measuring an initial rotation of a dart while the dart is stationary; measuring an acceleration and a rotation of the dart as the dart travels through a downhole passageway defined by a tubing string; adjusting the rotation using the initial rotation to provide a corrected rotation; adjusting the acceleration using the corrected rotation to provide a corrected acceleration; and integrating the corrected acceleration twice to obtain a distance value.

In some embodiments, the method comprises comparing the distance value with a target location and if the distance value is the same as the target location, activating the dart.

According to another broad aspect of the present disclosure, there is provided a method comprising detecting a change in magnetic field or magnetic flux as a dart travels through a downhole passageway defined by a tubing string; determining, based on the change in magnetic field or magnetic flux, a location of the dart relative to a target location.

In some embodiments, the change in magnetic field or magnetic flux is caused by a movement of a magnet in the dart.

In some embodiments, the change in magnetic field or magnetic flux is caused by the dart's proximity to or passage through a feature in the tubing string.

In some embodiments, the change in magnetic field or magnetic flux has an x-axis component, a y-axis component, and a z-axis component.

In some embodiments, the movement of the magnet is caused by a constriction in the tubing string.

In some embodiments, the method comprises activating the dart upon determining that the location of the dart is the same as the target location.

In some embodiments, the method comprises engaging, by the activated dart, a downhole tool.

In some embodiments, activating the dart comprises deploying a deployment element of the dart.

In some embodiments, the method comprises creating a fluid seal inside the passageway by engaging the deployed deployment element with a constriction in the tubing string downhole from the target location.

According to another broad aspect of the present disclosure, there is provided a dart comprising: a body; a control module in the body; an accelerometer in the body, the accelerometer being in communication with the control module and configured to measure an acceleration of the dart; a gyroscope in the body, the gyroscope being in communication with the control module and configured to measure a rotation of the dart; wherein the control module is configured to determine a location of the dart relative to a target location based on the acceleration and the rotation of the dart.

According to another broad aspect of the present disclosure, there is provided a dart comprising: a body; a control module inside the body; a magnetometer in the body, the magnetometer being in communication with the control module and configured to measure magnetic field or magnetic flux; wherein the control module is configured to identify a change in magnetic field or magnetic flux based on the measured magnetic field or magnetic flux, and to determine a location of the dart relative to a target location based on the change.

In some embodiments, the magnetic field or magnetic flux has an x-axis component, a y-axis component, and a z-axis component.

In some embodiments, the dart comprises a rare-earth magnet in the body.

In some embodiments, the dart comprises one or more retractable protrusions extending radially outwardly from the body; and a rare-earth magnet embedded in each of the one or more retractable protrusions.

In some embodiments, the dart comprises an actuation mechanism and the control module is configured to activate the actuation mechanism when the location is the same as the target location.

In some embodiments, the actuation mechanism comprises a deployment element deployable upon activation of the actuation mechanism.

In some embodiments, the deployment element is configured to radially expand when deployed.

In some embodiments, the deployment element is collapsible when not deployed and is un-collapsible when deployed.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. An apparatus for deployment within a passage of a wellbore flow conductor disposed within a wellbore, the wellbore passage being defined by a passage-defining surface of the wellbore flow conductor, comprising:

an actuator;

an engager including:

a sealed interface effector; and a sealed interface effector supporter including:

a first supporting member including a first free end and a second free end, such that a first gap extends from the first free end to the second free end; and a second supporting member including a first free end and a second free end, such that a second gap extends from the first free end to the second free end;

wherein:

the first supporting member is disposed between the sealed interface effector and the second supporting member;

wherein:

the apparatus is configurable in an expanded configuration for co-operating with the wellbore flow conductor for establishing a sealed interface within the wellbore, wherein the sealed interface is established by sealing engagement between the sealed interface effector and the passage-defining surface, wherein, in the expanded configuration, at least the actuator and the sealed interface effector supporter are co-operating to establish a supporting-effective configuration for opposing defeating of the sealed interface, wherein, in the supporting-effective configuration:

the first gap defines a first expanded configuration gap;

the second gap defines a second expanded configuration gap;

the first expanded configuration gap is offset relative to the second expanded configuration gap, such that an occluding portion of the second supporting member is occluding the first expanded configuration gap;

the second supporting member includes an end-adjacent portion, wherein, relative to the occluding portion, the end-adjacent portion is disposed closer to a one of the first free end, respective to the second supporting member, and the second free end, respective to the second supporting member; and the axial length of the occluding portion, as measured along a longitudinal axis of the apparatus, is greater than the axial length of the end-adjacent portion, as measured along a longitudinal axis of the apparatus.

2. The apparatus as claimed in claim 1;
wherein:
the opposing of the defeating of the sealed interface includes opposing of a force being applied to the sealed interface effector.

3. The apparatus as claimed in claim 2;
wherein:
the sealed interface effector supporter is disposed downhole relative to the sealed interface, such that the force being applied to the sealed interface effector, is a force being applied in a downhole direction.

4. The apparatus as claimed in claim 3;
wherein:
the establishment of the sealed interface within the wellbore includes a sealing engagement of the sealed interface effector to a sealing-effective portion of the passage-defining surface; and
the opposing, by the supporting-effective configuration, of the force being applied to the sealing interface effector, is an opposing of a force being applied along an axis that is perpendicular to an axis that is normal to the sealing-effective portion.

5. The apparatus as claimed in claim 4;
wherein:
the occluding is with effect that extrusion, of the sealed interface effector, via the first expanded configuration gap, is prevented by the occluding portion.

6. The apparatus as claimed in claim 5;
wherein:
the apparatus is further configurable in a retracted configuration, in the retracted configuration:
the first gap defines a first retracted configuration gap; and
the second gap defines a second retracted configuration gap;
the first expanded configuration gap is wider than the first retracted configuration gap; and
the second expanded configuration gap is wider than the second retracted configuration gap;
such that, the transitioning includes:
for the first supporting member:
a relative displacement between the first and second free ends; and
a widening of the first gap;
and
for the second supporting member:
a relative displacement between the first and second free ends; and
a widening of the second gap.

7. The apparatus as claimed in claim 6;
wherein:
the apparatus is transitionable from the retracted configuration to the expanded configuration, wherein the transitioning includes:
a radial expansion of the sealed interface effector;
a radial expansion of the first supporting member; and
a radial expansion of the second supporting member.

8. The apparatus as claimed in claim 7;
wherein:
the apparatus is co-operable with the wellbore flow conductor for establishing a retained configuration, wherein, in the retained configuration, the sealing interface is established and an engageable surface of the engager is disposed in abutting engagement with an opposing surface of a stop of the wellbore flow conductor.

9. The apparatus as claimed in claim 8;
wherein:
the actuator defines a frustoconical surface;
at least the actuator and the engager are co-operatively configured such that the engager is disposed in contact engagement with the frustoconical surface during the transitioning from the retracted configuration to the expanded configuration; and
the transitioning is responsive to relative movement, between the engager and the actuator, along an axis that is parallel to the longitudinal axis of the wellbore passage.

10. The apparatus as claimed in claim 9;
wherein:
the axial length of the end-adjacent portion is a fraction of the axial length of the occluding portion, and the fraction is within a range, and the range is from 10% to 30%.

11. The apparatus as claimed in claim 10;
wherein:
each one of the first and second supporting members, independently, is a split ring.

12. The apparatus as claimed in claim 11;
wherein:
the apparatus is a plug.

13. The apparatus as claimed in claim 1;
wherein:
the occluding is with effect that extrusion, of the sealed interface effector, via the first expanded configuration gap, is prevented by the occluding portion.

14. The apparatus as claimed in claim 1;
wherein:
the axial length of the end-adjacent portion is a fraction of the axial length of the occluding portion, and the fraction is within a range, and the range is from 10% to 30%.

15. The apparatus as claimed in claim 1;
wherein:
each one of the first and second supporting members, independently, is a split ring.

16. The apparatus as claimed in claim 1;
wherein:
the apparatus is transitionable from a retracted configuration to the expanded configuration, wherein the transitioning includes:
a radial expansion of the sealed interface effector;
a radial expansion of the first supporting member; and
a radial expansion of the second supporting member.

17. The apparatus as claimed in claim 1;
wherein:
the apparatus is co-operable with the wellbore flow conductor for establishing a retained configuration, wherein, in the retained configuration, the sealing interface is established and an engageable surface of the engager is disposed in abutting engagement with an opposing surface of a stop of the wellbore flow conductor.

* * * * *